US012000021B2

(12) United States Patent
Miyoshi et al.

(10) Patent No.: US 12,000,021 B2
(45) Date of Patent: Jun. 4, 2024

(54) α+β TYPE TITANIUM ALLOY WIRE AND MANUFACTURING METHOD OF α+β TYPE TITANIUM ALLOY WIRE

(71) Applicant: NIPPON STEEL CORPORATION, Tokyo (JP)

(72) Inventors: Ryotaro Miyoshi, Tokyo (JP); Tomonori Kunieda, Tokyo (JP); Kazuhiro Takahashi, Tokyo (JP); Tatsuo Yamazaki, Tokyo (JP); Akira Kawakami, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 292 days.

(21) Appl. No.: 17/281,029

(22) PCT Filed: Oct. 7, 2019

(86) PCT No.: PCT/JP2019/039473
§ 371 (c)(1),
(2) Date: Mar. 29, 2021

(87) PCT Pub. No.: WO2020/075667
PCT Pub. Date: Apr. 16, 2020

(65) Prior Publication Data

US 2021/0348252 A1 Nov. 11, 2021

(30) Foreign Application Priority Data

Oct. 9, 2018 (JP) ..... 2018-191179
Oct. 9, 2018 (JP) ..... 2018-191180

(51) Int. Cl.
*C22C 14/00* (2006.01)
*C21D 8/06* (2006.01)
*C21D 9/52* (2006.01)

(52) U.S. Cl.
CPC ..... *C22C 14/00* (2013.01); *C21D 8/06* (2013.01); *C21D 9/525* (2013.01)

(58) Field of Classification Search
CPC ..... C21D 8/06; C21D 9/525; C22C 14/00; C22F 1/18; C22F 1/183
(Continued)

(56) References Cited

U.S. PATENT DOCUMENTS 4,675,964 A * 6/1987 Allison ..... F01L 3/02 148/670
5,662,745 A * 9/1997 Takayama ..... C22F 1/183 148/237

FOREIGN PATENT DOCUMENTS

EP 0 608 431 A1 8/1994
JP S59-082101 A 5/1984
(Continued)

OTHER PUBLICATIONS

NPL: on-line translation of JP 08023053 B2, Mar. 1996 (Year: 1996).*

*Primary Examiner* — Jie Yang
(74) *Attorney, Agent, or Firm* — Myers Wolin, LLC

(57) ABSTRACT

An α+β type titanium alloy wire contains, in mass %, Al: 4.50 to 6.75%, Si: 0 to 0.50%, C: 0.080% or less, N: 0.050% or less, H: 0.016% or less, O: 0.25% or less, Mo: 0 to 5.5%, V: 0 to 4.50%, Nb: 0 to 3.0%, Fe: 0 to 2.10%, Cr: 0 to less than 0.25%, Ni: 0 to less than 0.15%, Mn: 0 to less than 0.25%, and the balance being Ti and impurities, the contents of Al, Mo, V, Nb, Fe, Cr, Ni, and Mn satisfying an equation, in which an average aspect ratio of an α crystal grain is 1.0 to 3.0, a maximum crystal grain diameter of the α crystal grain is 30.0 μm or less, an average crystal grain diameter of the α crystal grain is 1.0 to 15.0 μm.

6 Claims, 4 Drawing Sheets

(58) Field of Classification Search
USPC ..... 420/420
See application file for complete search history.

(56) References Cited

FOREIGN PATENT DOCUMENTS

| | | | | |
|---|---|---|---|---|
| JP | S61-210163 | A | | 9/1986 |
| JP | H06-081059 | A | | 3/1994 |
| JP | 08023053 | A | * | 1/1996 |
| JP | H10-306335 | A | | 11/1998 |
| JP | 2002-302748 | A | | 10/2002 |
| JP | 2004-131761 | A | | 4/2004 |

* cited by examiner

α+β TYPE TITANIUM ALLOY WIRE AND MANUFACTURING METHOD OF α+β TYPE TITANIUM ALLOY WIRE

CROSS-REFERENCE TO RELATED APPLICATION

This application is a national stage application of International Application No. PCT/JP2019/039473, filed on Oct. 7, 2019 and designated the U.S., which claims priority to Japanese Patent Application No. 2018-191179, filed on Oct. 9, 2018 and Japanese Patent Application No. 2018-191180, filed on Oct. 9, 2018. The contents of each are herein incorporated by reference.

TECHNICAL FIELD

The present disclosure relates to an α+β type titanium alloy wire and a manufacturing method of the α+β type titanium alloy wire.

BACKGROUND ART

Titanium is applied not only to a fastening member (fastener) such as a bolt of an aircraft or an automobile, but also to a member related to medical care, and in these applications, fatigue strength is important. In order to obtain high fatigue strength, it is important to increase material strength, and the aforementioned respective members are required to employ an α+β type titanium alloy excellent in strength. Further, there is a close relationship between fatigue properties and a metal structure, and an equiaxed crystal structure has fatigue properties better than those of an acicular structure. For this reason, when the fatigue properties are required with respect to titanium, it is demanded to create the equiaxed crystal structure in the α+β type titanium alloy.

The Ti-6Al-4V, being a general-purpose α+β type titanium alloy, is poor in workability at room temperature and thus is a material which is difficult to be worked, so that generally, when it is subjected to working, it is subjected to hot working in a β single-phase region or an α+β two-phase high-temperature region. However, if the α+β type titanium alloy is subjected to the hot working in the β single-phase region, an acicular structure is formed when transformation occurs from a β phase being a high-temperature stable phase into an α phase. For this reason, in order to obtain a titanium alloy having an equiaxed crystal structure, final working is generally performed in the α+β two-phase high-temperature region.

However, when the hot working is performed in the α+β two-phase high-temperature region, an α phase which is formed before performing the final hot working (proeutectoid α phase) is likely to become coarse. Further, even when the hot working is performed in the α+β two-phase high-temperature region, if a working amount during the final hot working is small or a working time becomes long, a coarse equiaxed crystal structure or a mixed grain size structure which is coarse and mixed with a fine equiaxed grain, is sometimes created due to a strain during the working. The smaller the crystal grain diameter, the better the fatigue properties, so that when a mixed grain or a coarse grain is formed, the fatigue properties sometimes deteriorate.

Further, since working heat generation is likely to occur in titanium, if titanium is worked at a high strain rate in the α+β two-phase region, it is sometimes heated to a β region due to the working heat generation. When titanium is heated to the β region, an acicular structure is formed when transformation occurs from a β phase into an α phase. Therefore, when performing the hot working in the α+β two-phase region, there is a need to perform working at a relatively low strain rate, and accordingly, a period of time taken for the working is increased, which becomes a cause of increasing cost.

The following Patent Document 1 proposes an α+β type titanium alloy excellent in toughness and fatigue properties in which hot working of 70% or more is performed at a temperature of 600° C. or more and a β transus (α+β/β phase region boundary) temperature or less, cooling is further performed at a cooling rate of less than 15° C/s to finely disperse and precipitate the α phase of 5 μm or less in the β phase, to thereby obtain an ultrafine grain structure.

The following Patent Document 2 proposes a titanium alloy wire in which a titanium alloy whose β transformation temperature is 860° C. or more and 920° C. or less has a structure formed of an equiaxed α phase and an equiaxed β structure and having an average crystal grain diameter of 1 μm.

The following Patent Document 3 proposes a manufacturing method of a fastener member made of a titanium alloy excellent in fatigue properties, the method being characterized in that, with respect to a titanium alloy satisfying 5≤Mo equivalent=[Mo]+0.67×[V]+1.67×[Cr]+2.86×[Fe]≤15, and 2.5≤Al equivalent=[Al]+0.33×[Sn]+0.17×[Zr]≤7.5, solution heat treatment is performed, screw working through form rolling is then performed, and after that, aging treatment is performed.

The following Patent Document 4 proposes a method of manufacturing a titanium alloy rod in which a rod-shaped raw material of titanium alloy is subjected to hot skew rolling by a skew rolling mill having three or four rolls at a reduction of area per one pass of 5% or more and 40% or less when the rolling is performed at an α phase region temperature and an α+β phase region temperature, or a reduction of area per one pass of 5% or more and 85% or less when the rolling is performed at a β phase region temperature.

The following Patent Document 5 proposes a titanium alloy wire suitable for manufacturing a valve, characterized in that a microstructure of an α+β type titanium alloy wire is set to either an equiaxed α crystal structure having a grain diameter of 6 μm or more and 25 μm or less or an acicular α crystal structure, or a structure obtained by mixing the above-described structures.

The following Patent Document 6 proposes a manufacturing method of a rod member made of titanium or titanium alloy, characterized in that it includes: a rolling step of making a raw material of titanium or titanium alloy to be a wire having a predetermined cross-sectional dimension; an annealing step of annealing the wire; a surface flaw removing step to be performed thereafter, in which a surface flaw of the wire is removed through shaving; and a cutting step of making the wire to be a rod member, in which the annealing step is carried out under conditions where the wire is heated and retained at 800° C. to 830° C. in a vacuum or inert gas atmosphere.

RELATED ART DOCUMENT

Patent Document

Patent Document 1: Japanese Laid-open Patent Publication No. S61-210163

Patent Document 2: Japanese Laid-open Patent Publication No. H10-306335

Patent Document 3: Japanese Laid-open Patent Publication No. 2004-131761

Patent Document 4: Japanese Laid-open Patent Publication No. S59-82101

Patent Document 5: Japanese Laid-open Patent Publication No. H6-81059

Patent Document 6: Japanese Laid-open Patent Publication No. 2002-302748

SUMMARY

Problems to Be Solved

In Patent Document 1, the α phase of 5 μm or less is finely precipitated in the β phase. However, since the working is performed in the α+β two-phase high-temperature region, the α phase is difficult to be divided, and thus there is a small effect of refinement of the α phase. Further, since the working temperature is high, there is a possibility that accumulation of a texture is difficult to occur, and a facet is likely to be formed in a fatigue test.

In Patent Document 2, the average crystal grain diameter is made to be 1 μm or less, which is very small. However, if the crystal grain diameter becomes excessively small, the strength is significantly increased to enhance notch sensitivity, which, on the contrary, may deteriorate the fatigue properties. Further, if the grain refining is excessively performed, ductility is reduced, which may reduce the workability at room temperature.

Regarding Patent Document 3, if the aging treatment is performed after the solution heat treatment, the α phase is precipitated in the β phase. However, there is a case where a variation in precipitation behavior occurs, which causes a variation in strength for each of crystal grains. If the variation in the strength for each of crystal grains occurs, the fatigue properties are sometimes lowered.

In Patent Document 4, the titanium alloy round rod is manufactured through the skew rolling by the skew rolling mill. However, when the skew rolling is employed, formation of void at a wire center portion is facilitated by the Mannesmann effect.

In each of Patent Document 5 and Patent Document 6, the manufacture is performed only by the hot rolling. In that case, even if the average crystal grain diameter is small, a coarse proeutectoid α phase may remain.

As described above, in the conventional titanium alloy, although a certain degree of fatigue properties can be exhibited, it is sometimes difficult to bring out high-level and stable fatigue properties. For this reason, a titanium alloy capable of stably exhibiting high fatigue strength is desired.

Accordingly, the present disclosure has been made in view of the above-described problems, and an object of the present disclosure is to provide an α+β type titanium alloy wire having further excellent fatigue properties, and a manufacturing method of the α+β type titanium alloy wire.

Means for Solving the Problems

The gist of the present disclosure made for solving the above-described problems is as follows.

[1] An α+β type titanium alloy wire contains, in mass %, Al: 4.50 to 6.75%, Si: 0 to 0.50%, C: 0.080% or less, N: 0.050% or less, H: 0.016% or less, O: 0.25% or less, Mo: 0 to 5.5%, V: 0 to 4.50%, Nb: 0 to 3.0%, Fe: 0 to 2.10%, Cr: 0 to less than 0.25%, Ni: 0 to less than 0.15%, Mn: 0 to less than 0.25%, and the balance being Ti and impurities, the contents of Al, Mo, V, Nb, Fe, Cr, Ni, and Mn satisfying the following equation (1), in which an average aspect ratio of an α crystal grain is 1.0 to 3.0, a maximum crystal grain diameter of the α crystal grain is 30.0 μm or less, an average crystal grain diameter of the α crystal grain is 1.0 μm to 15.0 μm, and an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5.0% or less.

$$-4.0 \leq [Mo]+0.67\,[V]+0.28\,[Nb]+2.9\,[Fe]+1.6\,[Cr]+1.1\,[Ni]+1.6\,[Mn]-[Al] \leq 2.0 \quad (1)$$

Here, in the above equation (1), notation of [symbol of element] represents a content (mass %) of a corresponding symbol of element, and a symbol of element which is not contained, is substituted by 0.

[2] The α+β type titanium alloy wire described in [1] contains, in mass %, Al: 5.50 to 6.75%, V: 3.50 to 4.50%, and Fe: 0.40% or less.

[3] The α+β type titanium alloy wire described in [1] contains, in mass %, Al: 4.50 to 6.40%, and Fe: 0.50 to 2.10%.

[4] In the α+β type titanium alloy wire described in any one of [1] to [3], the number of internal defects per unit area is 0 pieces/mm$^2$ to β pieces/mm$^2$.

[5] A manufacturing method of an α+β type titanium alloy wire being a method of manufacturing the α+β type titanium alloy wire described in any one of [1] to [4], includes: a first step being a step of performing working of one time or two times or more on a titanium alloy material having the chemical components described in any one of [1] to [3] at a working temperature in a range of 0° C. to 500° C., in which a reduction of area per one time of working is set to 10 to 50%, and a total reduction of area is set to 50% or more; and a second step of performing, with respect to the titanium alloy material after being subjected to the first step, final heat treatment in which a heat treatment temperature T is set to fall within a range of 700° C. to 950° C., and a heat treatment time t is set to a heat treatment time satisfying the following equation (2).

$$21000 < (T+273.15) \times (\log_{10}(t)+20) < 24000 \quad (2)$$

Here, in the above equation (2), T indicates the heat treatment temperature (° C.) in the second step, and t indicates the heat treatment time (hr) in the second step.

[6] In the manufacturing method of the α+β type titanium alloy wire described in [5], when the working is performed a plurality of times in the first step, intermediate annealing is performed between the working and the working.

Effect of the Invention

As described above, according to the present disclosure, it is possible to provide an α+β type titanium alloy wire capable of stably forming a fine equiaxed crystal structure and having further excellent fatigue properties, and a manufacturing method of the α+β type titanium alloy wire. Consequently, there are provided immeasurable industrial effects.

EMBODIMENTS FOR CARRYING OUT THE INVENTION

Hereinafter, preferred embodiments of the present disclosure will be described in detail while referring to the attached drawings. Note that in the present description and the drawings, components having substantially the same functional configurations are denoted by the same codes to omit overlapped explanation.

(Studies Conducted by Present Inventors)

In order to solve the above-described problems, the present inventors conducted earnest studies, and reached completion of an α+β type titanium alloy wire according to each of embodiments of the present disclosure and a manufacturing method thereof to be described in detail hereinbelow. Hereinafter, an outline of the studies conducted by the present inventors will be first described briefly.

Figure 1A:
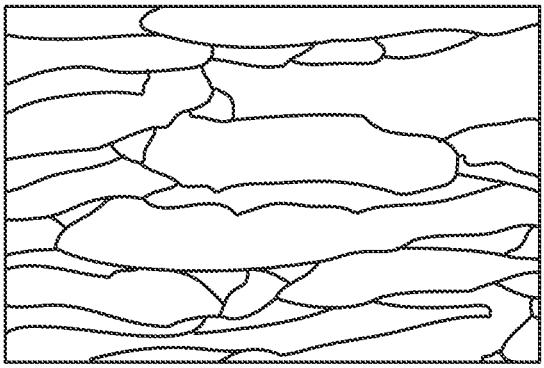
FIG. 1A is an explanatory diagram schematically illustrating one example of an anisometric crystal structure capable of being generated in an α crystal grain of an α+β type titanium alloy wire.
Figure 1B:
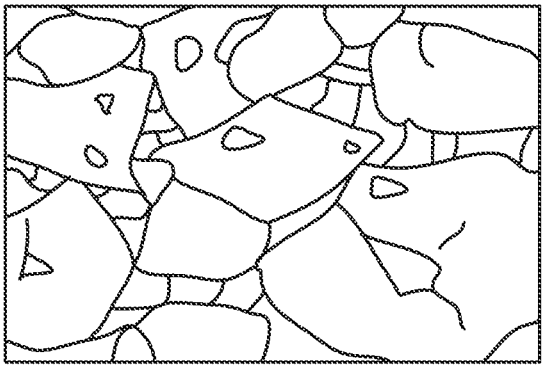
FIG. 1B is an explanatory diagram schematically illustrating one example of a mixed grain size structure capable of being generated in an α crystal grain of an α+β type titanium alloy wire.
Figure 1C:
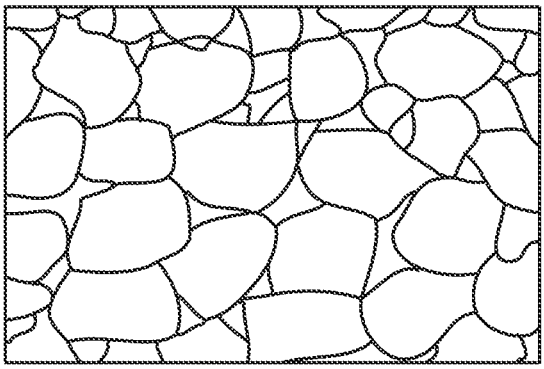
FIG. 1C is an explanatory diagram schematically illustrating one example of an equiaxed crystal structure capable of being generated in an α crystal grain of an α+β type titanium alloy wire.

As described above, when the equiaxed crystal structure is obtained in the α+β type titanium alloy wire typified by Ti-6Al-4V, the final working is conventionally performed in the α+β two-phase high-temperature region, so that there is a limit to make the α phase to be fine-grained. In addition to that, if a strain caused by the working is insufficient at the time of performing the working in the α+β two-phase high-temperature region, an anisometric crystal structure as schematically illustrated in FIG. 1A is likely to be formed. Further, if a working temperature is excessively high when performing the working in the α+β two-phase high-temperature region, grain growth is facilitated by a proeutectoid α phase and a strain, resulting in that a mixed grain size structure as schematically illustrated in FIG. 1B is likely to be formed. A fatigue fracture occurs at the weakest portion of the material, so that in order to improve the fatigue properties, it is important to create fine grains, and in addition to that, it is important to create a uniform structure. For this reason, in order to improve the fatigue properties, the present disclosure aims to make a metal structure of an α+β type titanium alloy to be an equiaxed structure which is uniform and which has fine grains, as schematically illustrated in FIG. 1C.

In order to increase fatigue strength of the α+β type titanium alloy, it is preferable that the alloy includes an equiaxed crystal structure having fine crystal grains and including no coarse crystal grains. In order to obtain such an equiaxed crystal structure, conventionally, a titanium alloy is subjected to hot working, to thereby form the equiaxed crystal structure. However, even when the α+β type titanium alloy is subjected to hot working, it is not always possible to obtain a preferable equiaxed crystal structure. Accordingly, the present inventors tried to perform cold working or warm working, which has not been studied very much so far, on the α+β type titanium alloy, and they found out that by combining predetermined conditions, it is possible to obtain an equiaxed crystal structure having fine crystal grains and including no coarse crystal grains. The equiaxed crystal structure capable of being obtained by the cold working or the warm working, becomes an equiaxed crystal structure which is quite excellent to the extent that it cannot be obtained by the hot working.

Here, in the present description, the "warm working" means performance of working within a temperature range of about 200 to 500° C. Further, the "hot working" means working within a temperature range of about 700 to 1000° C.

(α+β Type Titanium Alloy Wire)

An α+β type titanium alloy wire according to each of embodiments of the present disclosure contains, in mass %, Al: 4.50 to 6.75%, Si: 0 to 0.50%, C: 0.080% or less, N: 0.050% or less, H: 0.016% or less, O: 0.25% or less, Mo: 0 to 5.5%, V: 0 to 4.50%, Nb: 0 to 3.0%, Fe: 0 to 2.10%, Cr: 0 to less than 0.25%, Ni: 0 to less than 0.15%, Mn: 0 to less than 0.25%, and the balance being Ti and impurities, the contents of Al, Mo, V, Nb, Fe, Cr, Ni, and Mn satisfying the following equation (1), in which an average aspect ratio of an α crystal grain is 1.0 to 3.0, a maximum crystal grain diameter of the α crystal grain is 30.0 μm or less, an average crystal grain diameter of the α crystal grain is 1.0 μm to 15.0 μm, and an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5.0% or less.

Note that in each of the embodiments of the present disclosure, the wire indicates one having a diameter of 15 mm or less. Further, in an aircraft industry, for example, a wire in high demand is one having a diameter of about 4 mm to 10 mm.

(Chemical Components)

First, chemical components of the α+β type titanium alloy wire according to each of the embodiments of the present disclosure will be described. In the following explanation, "mass" % will be simply abbreviated to "%". Further, "A to B" (A and B are numeric values of contents, grain diameters, temperatures, and the like) means A or more and B or less.

[Al: 4.50 to 6.75%]

Aluminum (Al) is an element with high solid solution strengthening performance, and when its content is increased, tensile strength at room temperature becomes high. In order to obtain desired tensile strength and to control a crystal orientation of a texture to be obtained to fall within a desired range, a lower limit of the content of Al is set to 4.50%. The content of Al is preferably 4.60% or more. On the other hand, if Al of more than 6.75% is contained, the degree of contribution to the tensile strength is saturated, and in addition to that, hot workability and cold workability are lowered. For this reason, an upper limit of the content of Al is set to 6.75%. The content of Al is preferably 6.50% or less.

[Si: 0 to 0.50%]

Silicon (Si) is a β stabilizing element, but, it is solid-dissolved also in the α phase to exhibit a high solid solution strengthening performance. For this reason, in the a+β type titanium alloy wire according to each of the embodiments of the present disclosure, the strength may be increased through the solid solution strengthening of Si, according to need. Si is an arbitrary additive element, so that a lower limit of its content may be 0%. Further, when a proper amount of Si is combined with O to be contained, it can be expected to realize both high fatigue strength and high tensile strength. Such an effect can be securely exhibited by making the content of Si to be 0.05% or more, so that when Si is contained, the content of Si is preferably set to 0.05% or more. The content of Si is more preferably 0.10% or more. On the other hand, if Si is excessively contained, it forms an intermetallic compound called a silicide, which reduces the fatigue strength. If Si of more than 0.50% is contained, a coarse silicide is generated during a manufacturing process, which reduces the fatigue strength. For this reason, an upper limit of the content of Si is set to 0.50%. The content of Si is preferably 0.45% or less, and more preferably 0.40% or less.

The α+β type titanium alloy wire according to the present embodiment contains one kind or two kinds or more selected from a group consisting of Mo, V, Nb, Fe, Cr, Ni, and Mn, on condition that an equation (1) is satisfied. Each of these elements is a general element that realizes β stabilization, and when an appropriate amount thereof is contained, there is provided an effect of improving both strength and formability. If the addition amount is excessively small, the above-described merit cannot be obtained, and if the addition amount is excessively large, problems such as segregation, reduction in ductility, and formation of intermetallic compound, are caused, so that the contents thereof are defined as follows.

[Mo: 0 to 5.5%]

Molybdenum (Mo) is an arbitrary element, and thus it may not be contained. Specifically, the Mo content may be 0%. Further, Mo can be contained on condition that the equation (1) is satisfied. If even a little amount of Mo is contained, the above-described effect can be obtained to a certain degree. However, if the Mo content is excessively high, the segregation occurs to reduce the fatigue properties. Therefore, an upper limit of the Mo content is set to 5.5%. A preferable lower limit of the Mo content for more effectively increasing the above-described effect, is 2.00%, and the lower limit is more preferably 2.50%. A preferable upper limit of the Mo content is 3.7%, and the upper limit is more preferably 3.5%.

[V: 0 to 4.50%]

Vanadium (V) is an arbitrary element, and thus it may not be contained. Specifically, the V content may be 0%. Further, V can be contained on condition that the equation (1) is satisfied. If even a little amount of V is contained, the above-described effect can be obtained to a certain degree. However, if the V content is excessively high, the strength is excessively increased to lower the cold workability and warm workability. Therefore, an upper limit of the V content is set to 4.50%. A preferable lower limit of the V content for more effectively increasing the above-described effect, is 2.00%, and the lower limit is more preferably 2.50%. A preferable upper limit of the V content is 4.40%, and the upper limit is more preferably 4.30%.

[Nb: 0 to 3.0%]

Niobium (Nb) is an arbitrary element, and thus it may not be contained. Specifically, the Nb content may be 0%. Further, Nb can be contained on condition that the equation (1) is satisfied. If even a little amount of Nb is contained, the above-described effect can be obtained to a certain degree. However, if the Nb content is excessively high, the segregation occurs to reduce the fatigue properties. Therefore, an upper limit of the Nb content is set to 3.0%. A preferable lower limit of the Nb content for more effectively increasing the above-described effect, is 0.5%, and the lower limit is more preferably 0.7%. A preferable upper limit of the Nb content is 2.7%, and the upper limit is more preferably 2.5%.

[Fe: 0 to 2.10%]

Iron (Fe) is an arbitrary element, and thus it may not be contained. Specifically, the Fe content may be 0%. Further, Fe can be contained on condition that the equation (1) is satisfied. If even a little amount of Fe is contained, the above-described effect can be obtained to a certain degree. However, if the Fe content is excessively high, the segregation occurs to reduce the fatigue properties. Therefore, an upper limit of the Fe content is set to 2.10%. A preferable lower limit of the Fe content for more effectively increasing the above-described effect, is 0.10%, and the lower limit is more preferably 0.80%. A preferable upper limit of the Fe content is 2.00%.

[Cr: 0 to less than 0.25%]

Chromium (Cr) is an arbitrary element, and thus it may not be contained. Specifically, the Cr content may be 0%. Further, Cr can be contained on condition that the equation (1) is satisfied. If even a little amount of Cr is contained, the above-described effect can be obtained to a certain degree. However, if the Cr content is excessively high, an intermetallic compound ($TiCr_2$) being an equilibrium phase is generated, which deteriorates the fatigue strength and the ductility at room temperature. Therefore, the Cr content is set to less than 0.25%. A preferable lower limit of the Cr content for more effectively increasing the above-described effect, is 0.05%, and the lower limit is more preferably 0.07%. A preferable upper limit of the Cr content is 0.20%, and the upper limit is more preferably 0.15%.

[Ni: 0 to less than 0.15%]

Nickel (Ni) is an arbitrary element, and thus it may not be contained. Specifically, the Ni content may be 0%. Further, Ni can be contained on condition that the equation (1) is satisfied. If even a little amount of Ni is contained, the above-described effect can be obtained to a certain degree. However, if the Ni content is excessively high, an intermetallic compound (Ti2Ni) being an equilibrium phase is generated, which deteriorates the fatigue strength and the ductility at room temperature. Therefore, the Ni content is set to less than 0.15%. A preferable lower limit of the Ni content for more effectively increasing the above-described effect, is 0.05%, and the lower limit is more preferably 0.07%. A preferable upper limit of the Ni content is 0.13%, and the upper limit is more preferably 0.11%.

[Mn: 0 to less than 0.25%]

Manganese (Mn) is an arbitrary element, and thus it may not be contained. Specifically, the Mn content may be 0%. Further, Mn can be contained on condition that the equation (1) is satisfied. If even a little amount of Mn is contained, the above-described effect can be obtained to a certain degree.

However, if the Mn content is excessively high, an intermetallic compound (TiMn) being an equilibrium phase is generated, which deteriorates the fatigue strength and the ductility at room temperature. Therefore, the Mn content is set to less than 0.25%. A preferable lower limit of the Mn content for more effectively increasing the above-described effect, is 0.05%, and the lower limit is more preferably 0.07%. A preferable upper limit of the Mn content is 0.20%, and the upper limit is more preferably 0.15%.

[Regarding equation (1)]

In the chemical components of the α+β type titanium alloy wire according to each of the embodiments of the present disclosure, the contents of Al, Mo, V, Nb, Fe, Cr, Ni, and Mn further satisfy the following equation (1).

$$-4.0 \leq [Mo]+0.67\,[V]+0.28\,[Nb]+2.9\,[Fe]+1.6\,[Cr]+1.1\,[Ni]+1.6\,[Mn]-[Al] \leq 2.0 \quad (1)$$

Note that in the equation (1), notation of [symbol of element] represents a content (mass %) of a corresponding symbol of element, and a symbol of element which is not contained, is substituted by 0.

$$A=[Mo]+0.67\,[V]+0.28\,[Nb]+2.9\,[Fe]+1.6\,[Cr]+1.1\,[Ni]+1.6\,[Mn]-[Al]$$

Here, the Mo equivalent A represented by the right side of the above equation (1) is used for digitizing the degree of stabilization of β phase realized by Mo, V, Nb, Fe, Cr, Ni, and Mn each of which is the β stabilizing element described in the equation. At this time, by setting the degree of stabilization of β phase realized by Mo as a reference, the degree of stabilization of β phase realized by the β stabilizing elements other than Mo is relativized by a positive coefficient. On the other hand, Al is an α stabilizing element, so that in the above-described Mo equivalent A, a coefficient regarding Al is a negative value.

[Range of Mo Equivalent A: $-4.0 \leq A \leq 2.0$]

The α+β type titanium alloy wire according to each of the embodiments of the present disclosure contains at least any one or more of elements selected from a group consisting of Mo, V, Nb, Fe, Cr, Ni, and Mn, so that the value of the Mo equivalent A represented by the above equation (1) falls within a range of −4.0 or more and 2.0 or less. When the value of the above-described Mo equivalent A is less than −4.0, the area ratio of the α phase becomes excessively high, which reduces the workability. A lower limit of the Mo equivalent A is preferably −3.5, and more preferably -3.0. On the other hand, when the value of the Mo equivalent A exceeds 2.0, the β phase becomes excessively hard, which reduces the workability. An upper limit of the Mo equivalent A is preferably 1.8, and more preferably 1.1.

[C: 0.080% or less]

[N: 0.050% or less]

[H: 0.016% or less]

[O: 0.25% or less]

When a content of each of carbon (C), nitrogen (N), hydrogen (H), and oxygen (O) is large, there is a case where the ductility and the workability are lowered, so that the content of C is controlled to 0.080% or less, the content of N is controlled to 0.050% or less, the content of H is controlled to 0.016% or less, and the content of O is controlled to 0.25% or less. Note that C, N, H, and O are impurities which are inevitably mixed, so that the lower the content of each of the elements, the more preferable. Further, C, N, H, and O are impurities which are inevitably mixed, and thus they are inevitably contained, so that substantial lower limits of the contents of C, N, H, and O are normally 0.0005%, 0.0001%, 0.0005%, and 0.01%, respectively.

The titanium alloy wire according to the present embodiment is composed of, other than the above-described elements, Ti and impurities (balance). However, an element other than the above-described respective elements can be contained within a range which does not impair the effect of the present disclosure. Note that "impurities" in the present embodiment indicate components which are mixed when industrially manufacturing a titanium alloy due to various reasons in a manufacturing process, including a raw material such as titanium sponge and scrap, and "impurities" also include components which are inevitably mixed. As such impurities, there can be cited, for example, tin (Sn), zirconium (Zr), copper (Cu), lead (Pd), tungsten (W), boron (B), and so on. When Sn, Zr, Cu, Pd, W, and B are contained as impurities, contents thereof are respectively 0.05% or less, and are 0.10% or less in total, for example.

[Area Ratio of β Phase]

In the metal structure of the α+β type titanium alloy wire according to each of the embodiments of the present disclosure, the α phase is a main body, and a small amount of β phase exists in the α phase. Here, when the α phase is the "main body", this means that the area ratio of the α phase is 80% or more. In each of the embodiments of the present disclosure, the area ratio of the β phase becomes approximately about 5% to 20%. Note that in the titanium alloy wire targeted by each of the embodiments of the present disclosure, it is difficult to measure the area ratio of the β phase, and an allowable measurement error is ±5%.

[Average Aspect Ratio of α Crystal Grain]

The fatigue strength greatly depends on the microstructure and the crystal grain diameter. In the metal material, the equiaxed crystal structure has the fatigue strength higher than that of the acicular structure. For this reason, in order to improve the fatigue properties, the existence of the equiaxed crystal structure is important. Whether the equiaxed crystal structure exists or not can be evaluated based on an average aspect ratio (length in long axis direction/length in short axis direction) of the α crystal grain. In the a+β type titanium alloy wire according to the present embodiment, if the average aspect ratio of the α crystal grain is 1.0 or more and 3.0 or less, it can be judged that there exists the equiaxed crystal structure. When the average aspect ratio of the α crystal grain exceeds 3.0, a so-called acicular structure is created, so that the average aspect ratio of the α crystal grain is set to 3.0 or less. The average aspect ratio of the α crystal grain is preferably 2.5 or less, and more preferably 2.3 or less.

[Average Crystal Grain Diameter of α Crystal Grain]

Next, an average crystal grain diameter of the α crystal grain will be described.

In the metal material, as the crystal grain diameter becomes smaller, an effective slip length under repetitive stress is reduced, to thereby uniformize slip deformation. This significantly improves resistance of crack initiation, resulting in that the fatigue properties are improved. In the conventional rolling in the α+β two-phase region, a structure in a prior β crystal grain becomes relatively fine because of the transformation and the working, but, a proeutectoid α phase portion remains, and thus a coarse crystal grain remains. For this reason, regarding the reduction in the resistance of crack initiation, it is important that (1) the average crystal grain diameter is made to be very small, and other than that, it is important that (2) a uniform structure is created in order to prevent mixed grains.

Here, if the average crystal grain diameter of the α crystal grain is 15.0 μm or less, a sufficient effect with respect to the crack initiation can be obtained. Accordingly, in the α+β type titanium alloy wire according to each of the embodiments of the present disclosure, the average crystal grain diameter of the α crystal grain is set to 15.0 μm or less. The average crystal grain diameter of the α crystal grain is preferably 12.0 μm, and more preferably 10.0 μm. The finer the grain, the higher the effect, so that a lower limit of the average crystal grain diameter of the α crystal grain is not particularly defined. However, it is difficult, in terms of manufacture, to produce a structure having an average crystal grain diameter of less than 1.0 μm, so that 1.0 μm can be set to the lower limit of the average crystal grain diameter of the α crystal grain.

[Maximum Crystal Grain Diameter of α Crystal Grain]

On the other hand, the fatigue of the metal material occurs at the weakest portion of a member, so that even when the fatigue strength of one portion is high, the fatigue strength is not improved, and it is lowered on the contrary. For this reason, as described above, it is important not only to make the average crystal grain diameter of the α crystal grain to be very small, but also to make the whole structure to be a uniform structure. Specifically, when the maximum crystal grain diameter is excessively large, a coarse crystal grain becomes a starting point to cause a fracture. When the maximum crystal grain diameter is 30.0 μm or less, there is no large influence on the reduction in the fatigue strength, so that in the α+β type titanium alloy wire according to each of the embodiments of the present disclosure, the maximum crystal grain diameter of the α crystal grain is set to 30.0 μm or less. The maximum crystal grain diameter of the α crystal grain is preferably 25.0 μm or less, and more preferably 20.0 μm or less.

[Measuring Method of Area Ratio of β Phase]

The area ratio of the β phase is measured in a manner that an L cross section cut from a titanium alloy wire after being subjected to heat treatment to be described later, is turned into a mirror surface by electrolytic polishing or colloidal silica polishing, and then the area ratio is measured by using an electron probe micro analyzer (EPMA). Concretely, in a region with a size of 500 μm×500 μm in the L cross section after being turned into the mirror surface, the measurement is performed with respect to about 2 to 10 fields of view at a step of 0.5 to 2 μm, an acceleration voltage of 10 kV, and a current of 50 to 100 nA. A region in which the solid-dissolved β stabilizing element is thickened five times or more when compared to its periphery, is regarded as a β phase, and based on an area of the defined β phase region and the total area of 500 μm×500 μm, the area ratio of the β phase is calculated.

[Measuring Method of Average Aspect Ratio of α Crystal Grain]

The average aspect ratio of the α crystal grain is measured in a manner that an L cross section cut from a titanium alloy wire after being subjected to heat treatment to be described later, is turned into a mirror surface by electrolytic polishing or colloidal silica polishing, and then the average aspect ratio is measured by using an electron back scattering diffraction pattern (EBSD). Concretely, in a region with a size of 500 μm×500 μm in the L cross section after being turned into the mirror surface, the measurement is performed with respect to about 2 to 10 fields of view at a step of 0.5 to 1 μm. After that, when a misorientation of 5° or more occurs, it is regarded that a grain boundary is created, a ratio of maximum lengths between a long axis direction of each crystal grain and a direction orthogonal to the long axis (long axis/short axis), namely, an aspect ratio is calculated, and an average value of all α crystal grains (average aspect ratio) is calculated.

[Measuring Method of α Crystal Grain Diameter]

The α crystal grain diameter is measured similarly to the measuring method of the average aspect ratio, in which in a region with a size of 500 um×500 μm in an L cross section after being turned into a mirror surface, the measurement is performed with respect to about 2 to 10 fields of view at a step of 0.5 to 1 μm. After that, when a misorientation of 5° or more occurs, it is regarded that a grain boundary is created, and a circle-equivalent grain diameter D is determined from a crystal grain area A (crystal grain area $A=\pi(D/2)^2$). The average crystal grain diameter is set to an average value of all α crystal grain diameters within the measurement range. Further, the maximum crystal grain diameter is set to a maximum value of the α crystal grain diameter within the measurement range. Note that the α crystal grain and the other crystal grain such as the β crystal grain, can be easily distinguished in a technical manner on the EBSD.

[Texture]

The fracture due to fatigue in the α+β type titanium alloy wire occurs when a crack is initiated from a part called a facet, and this crack is developed. This tendency becomes significant in a high cycle fatigue, in particular. The facet is formed substantially in parallel to a (0001) plane of a hexagonal close-packed structure (hcp) being a crystal structure of the a phase. When the fatigue occurs, if a facet is inclined to an angle of 15° to 40° relative to a stress load direction, the Schmit factor of a (0001) plane to be the facet becomes high, resulting in that the facet is highly formed. For this reason, making it difficult to form the facet is effective for improving the fatigue properties.

Accordingly, in the α+β type titanium alloy wire according to each of the embodiments of the present disclosure, an area ratio of the α crystal grain, out of the α crystal grains in a cross section orthogonal to a long axis direction of the wire, regarding which an inclination angle in a c-axis direction of the hexagonal close packing crystal that forms the α crystal grain relative to the long axis direction is within a range of 15° to 40°, is set to 5.0% or less. If this condition is satisfied, it is possible to suppress the formation of facet, which provides excellent fatigue properties. There is no problem if the area ratio of the α crystal grain regarding which the angle made by the c-axis of the hexagonal close packing crystal (hcp) and the long axis direction of the α+β type titanium alloy wire is 15° or more and 40° or less, is low, so that a lower limit of the area ratio is preferably 0%.

Figure 2:
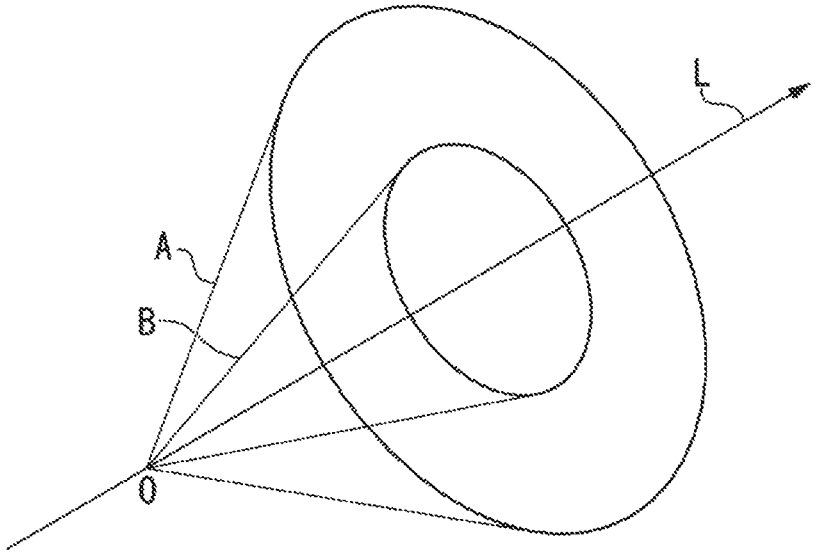
FIG. 2 is a schematic diagram explaining inclination angles in a c-axis direction of a hexagonal close packing crystal that forms an α crystal grain of an α+β type titanium alloy wire according to respective embodiments of the present disclosure.
Figure 3:
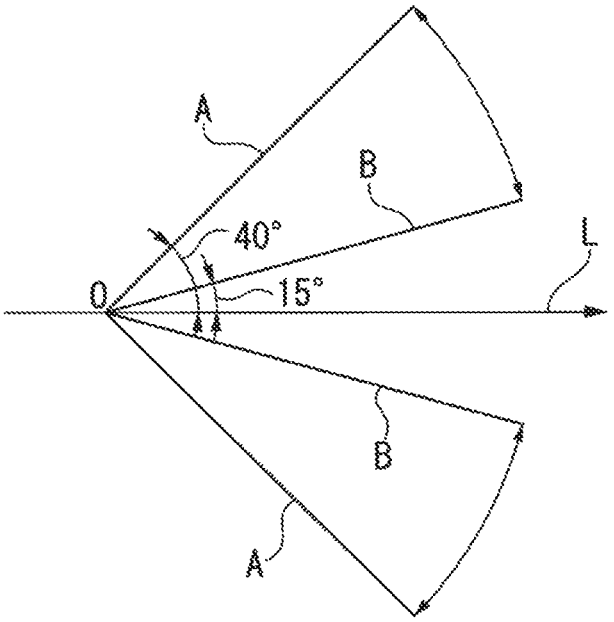
FIG. 3 is a schematic diagram explaining the inclination angles in the c-axis direction of the hexagonal close packing crystal that forms the α crystal grain of the α+β type titanium alloy wire according to the same embodiments.
Figure 4:
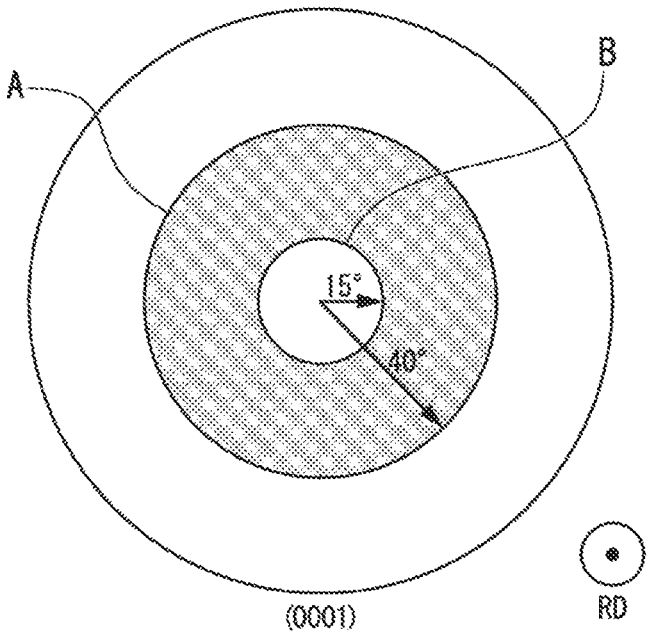
FIG. 4 is a schematic diagram of a (0001) positive pole figure seen from a long axis direction.

Here, the made angle 15° to 40° indicates all within a ring-shaped region in a (0001) positive pole figure seen from the long axis direction, as illustrated in FIG. 2 to FIG. 4. Here, in FIG. 2, a code L denotes a straight line indicating a long axis direction of a wire. Further, a code A denotes a boundary surface whose angle relative to the long axis direction L indicates 40°, and a code B denotes a boundary surface whose angle relative to the long axis direction L indicates 15°. FIG. 3 is a diagram seen from a direction intersecting the long axis direction L in FIG. 2, and FIG. 4 illustrates a (0001) positive pole figure seen from the long axis direction.

In FIG. 2 and FIG. 3, when a point O is set on the straight line indicating the long axis direction L, the boundary surface A makes an angle of 40° relative to the long axis direction L at the point O, and the boundary surface B makes an angle of 15° relative to the long axis direction L at the point O. [0062]

In most cases, the angle made between the direction of c-axis of the α crystal grain included in the metal structure of the titanium alloy according to each of the embodiments of the present disclosure and the long axis direction L falls within a range of less than 15° (a range on the inner side of the boundary surface B). Further, an area ratio of the α crystal grain whose angle made with the long axis direction L is within a range of 15° to 40° (a range between the boundary surface B and the boundary surface A), is 5.0% or less. The area ratio of the α crystal grain whose angle made with the long axis direction L is within the range of 15° to 40° (the range between the boundary surface B and the boundary surface A), is preferably 4.0% or less, and more preferably 3.0% or less.

[Measuring Method of Texture]

The above-described texture can be observed in a manner as follows.

In a similar manner to the above-described measuring method of the crystal grain diameter, an L cross section cut from an α+β type titanium alloy wire after being subjected to heat treatment to be described later (a cross section orthogonal to a long axis direction of the wire), is turned into a mirror surface by electrolytic polishing or colloidal silica polishing, and then the texture is measured by using an electron back scattering diffraction pattern (EBSD). Concretely, in a region with a size of 500 μm×500 μm, the measurement is performed with respect to about 2 to 10 fields of view at a step of 0.5 to 1 μm, and an area ratio of the α crystal grain regarding which an angle made between a c-axis of a hexagonal close packing crystal (hcp) and the long axis direction of the α+β type titanium alloy wire is 15° or more and 40° or less in each field of view is determined. After that, an average of the area ratios of the α crystal grains obtained in the respective fields of view is determined. The calculated area ratio is an area ratio with respect to the whole surface of the L cross section.

(Outline of Manufacturing Method of α+β Type Titanium Alloy Wire)

As described above, even when the equiaxed a structure is created, if the angle made between the direction of c-axis of the α crystal grain and the long axis direction L is within the range of 15° to 40°, the fatigue properties are lowered. Regarding the α phase, the angle made between the direction of c-axis and the long axis direction L is converged to 0° by repeatedly performing wire drawing. However, when the hot working is performed in the α+β two-phase high-temperature region as in the conventional method, the α phase is precipitated in random directions from the β phase during a process of cooling. In consequence of this, the proportion of α phase regarding which the angle made between the direction of c-axis of the α crystal grain and the long axis direction L is within the range of 15° to 40°, is increased.

On the other hand, in the α+β type titanium alloy wire according to each of the embodiments of the present disclosure, as mentioned before, the cold working or the warm working is performed in the temperature region of 0° C. to 500° C. to make the α crystal grain to be the equiaxed one, which is different from a conventional way. By performing the cold working or the warm working, a β phase fraction in the metal structure becomes about the same as that at normal temperature (room temperature), so that it is possible to suppress an orientation spread of the α phase due to the phase transformation such as one caused in the hot working. Besides, by performing low-temperature working such as the cold working or the warm working, dislocation increases due to the low-temperature working, which makes it possible to more uniformly generate a finer equiaxed structure. In addition to that, the c-axis of the α crystal grain is more likely to be converged to 0° direction, when compared to the conventional hot working. Consequently, the α+β type titanium alloy wire according to each of the embodiments of the present disclosure has further excellent fatigue properties. Further, the working in the cold to warm temperature region can be performed, which is very advantageous in terms of cost reduction.

Further, in the manufacturing method of the α+β type titanium alloy wire according to each of the embodiments of the present disclosure, it is possible to perform a plurality of times of working when performing the cold working or the warm working in the temperature region of 0° C. to 500° C., as will be described again in detail hereinbelow. Further, when performing the plurality of times of working, it is preferable to perform intermediate annealing between the n-th (n is an integer of 1 or more) working and the (n+1)-th working.

In such intermediate annealing, even if the β phase fraction is increased, an orientation of the α phase precipitated from the β phase during cooling, is an orientation at the time of starting the annealing. For this reason, the proportion of the α phase inclined to 15° to 40° becomes low to be 5.0% or less. However, by performing the working in the cold to warm temperature region, although the crystal orientation of the texture is aligned, there is no chance that the orientation is aligned perfectly, and there remains the α phase having a random crystal orientation.

The manufacturing method of the α+β type titanium alloy wire according to each of the embodiments of the present disclosure, having the characteristics as described above, will be described again in detail hereinbelow.

Hereinafter, the α+β type titanium alloy wire according to the embodiment of the present disclosure having the characteristics as described above, and the manufacturing method of the α+β type titanium alloy wire, will be described in more detail while citing further concrete chemical components.

First Embodiment

Hereinafter, an α+β type titanium alloy wire being a first embodiment of the present disclosure, and a manufacturing method thereof, will be described in detail. The α+β type titanium alloy wire according to the present embodiment is a titanium alloy wire containing V and Fe, out of titanium alloy wires whose chemical components are defined by using the Mo equivalent A as described above.

<α+β Type Titanium Alloy Wire>

An α+β type titanium alloy wire according to the present embodiment contains, in mass %, Al: 5.50 to 6.75%, V: 3.50 to 4.50%, Fe: 0.40% or less, C: 0.080% or less, N: 0.050% or less, H: 0.016% or less, O: 0.25% or less, and the balance being Ti and impurities, in which an average aspect ratio of an α crystal grain is 1.0 to 3.0, a maximum crystal grain diameter of the α crystal grain is 20.0 μm or less, an average crystal grain diameter of the α crystal grain is 1.0 to 10.0 μm, and an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5.0% or less.

First, the chemical components of the α+β type titanium alloy wire according to the present embodiment will be described again hereinbelow. In the following explanation, "mass %" will be simply abbreviated to "%".

[Content of Al]

Al is an element with high solid solution strengthening performance, and when its content is increased, tensile strength at room temperature becomes high. In order to more securely obtain desired tensile strength and to more securely control a crystal orientation of a texture to be obtained to fall within a desired range, the content of Al is preferably set to 5.50% or more, and more preferably set to 5.70% or more. On the other hand, if Al of more than 6.75% is contained, the degree of contribution to the tensile strength is saturated, and in addition to that, hot workability and cold workability are lowered. For this reason, an upper limit of the content of Al is set to 6.75%. The content of Al is preferably 6.50% or less.

[Content of V]

V is an element with high solid solution strengthening performance, and when its content is increased, tensile strength at room temperature becomes high. Further, there is a need to maintain a β phase with good workability at room temperature. For this reason, the content of V is preferably set to 3.50% or more, and is more preferably 3.60% or more. On the other hand, if V of more than 4.50% is contained, the strength becomes excessively high, which reduces the cold workability and the warm workability. For this reason, the content of V is preferably set to 4.50% or less. The content of V is more preferably 4.30% or less.

[Content of Fe]

Fe sometimes causes segregation to reduce homogeneity, so that its content is preferably limited to 0.40% or less, and more preferably limited to 0.25% or less. Fe has solid solution strengthening performance, and provides an effect of contributing to the improvement of strength at room temperature, so that Fe is preferably contained by 0.10% or more.

[Contents of C, N, H, O]

When a content of each of C, N, H, and O is large, there is a case where the ductility and the workability are lowered, so that the content of C is preferably controlled to 0.080% or less, the content of N is preferably controlled to 0.050% or less, the content of H is preferably controlled to 0.016% or less, and the content of O is preferably controlled to 0.25% or less. Note that C, N, H, and O are impurities which are inevitably mixed, so that the lower the content of each of the elements, the more preferable. Further, C, N, H, and O are impurities which are inevitably mixed, and thus they are inevitably contained, so that substantial lower limits of the contents of C, N, H, and O are normally 0.0005%, 0.0001%, 0.0005%, and 0.01%, respectively.

The α+β type titanium alloy wire according to the present embodiment is composed of, other than the above-described elements, Ti and impurities (balance). However, an element other than the above-described respective elements can be contained within a range which does not impair the effect of the present disclosure.

[Area Ratio of β Phase]

Also in the metal structure of the α+β type titanium alloy wire according to the present embodiment, the α phase is a main body, and a small amount of β phase exists in the α phase. In the present embodiment, the area ratio of the α phase is 80% or more, and is approximately about 80 to 97%. In the present embodiment, the area ratio of the β phase is approximately about 3 to 20%.

[Average Aspect Ratio of α Crystal Grain]

As mentioned before, in order to improve the fatigue properties, the existence of the equiaxed crystal structure is important. For this reason, in the α+β type titanium alloy wire according to the present embodiment, the average aspect ratio of the α crystal grain is preferably set to 1.0 or more and 3.0 or less. The average aspect ratio of the α crystal grain is more preferably 2.5 or less, and still more preferably 2.3 or less.

[Average crystal grain diameter of α crystal grain]

Further, in the α+β type titanium alloy wire according to the present embodiment, in order to more securely obtain the effect of reducing the crack initiation, the average crystal grain diameter of the α crystal grain in the α+β type titanium alloy wire is preferably set to 15.0 μm or less as described above. In the present embodiment, the average crystal grain diameter of the α crystal grain is more preferably 12.0 μm or less, and still more preferably 10.0 μm or less.

[Maximum Crystal Grain Diameter of α Crystal Grain]

Further, in order to more securely suppress the reduction in the fatigue strength, in the α+β type titanium alloy wire according to the present embodiment, the maximum crystal grain diameter of the α crystal grain is preferably set to 30.0 μm or less, as described above. The maximum crystal grain diameter of the α crystal grain is more preferably 25.0 μm or less, and still more preferably 20.0 μm or less.

Note that as the measuring methods of the area ratio of the β phase, the average aspect ratio of the α crystal grain, and the α crystal grain, the measuring methods described before may be used, so that detailed explanation thereof will be omitted hereinbelow.

[Texture]

Also in the α+β type titanium alloy wire according to the present embodiment, an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is preferably set to 5.0% or less. The area ratio of the α crystal grain whose angle made with the long axis direction L is within the range of 15° to 40° (the range between the boundary surface B and the boundary surface A), is more preferably 4.0% or less, and still more preferably 3.0% or less. There is no problem if the area ratio of the α crystal grain regarding which the angle made by the c-axis of the hexagonal close packing crystal (hcp) and the long axis direction of the α+β type titanium alloy wire is 15° or more and 40° or less, is low, so that a lower limit of the area ratio is preferably 0%. Note that as the measuring method of the texture, the measuring method described before may be used, so that detailed explanation thereof will be omitted hereinbelow.

[Internal Defect]

As described above, the high-strength α+β type titanium alloy typified by Ti-6Al-4V has poor workability in the range of room temperature to warm temperature, and an internal defect is likely to occur during deformation working. The internal defect in this case indicates a void or a crack. On the other hand, the fatigue properties to be described later may deteriorate when there are a lot of internal defects.

In the α+β type titanium alloy wire according to the present embodiment, a generation amount of the internal defects (namely, the number of internal defects per unit area) is normally 0 pieces/mm$^2$. However, as a result of earnest studies, as long as the generation amount of the internal defects falls within a range of 13 pieces/mm$^2$ or less, an influence is not exerted on the fatigue properties exhibited in the α+β type titanium alloy wire according to the present embodiment.

[Measuring Method of Internal Defect]

The generation amount of the internal defects is measured in a manner that a C cross section cut from a titanium alloy wire after being subjected to heat treatment to be described later, is turned into a mirror surface by using an emery paper and buffing, and then the generation amount is measured by using an optical microscope. Photographing is performed on 10 to 20 fields of view at 50 to 500 magnifications, the number of defects such as voids or cracks that exist in each field of view is measured, the number is divided by an observation area to determine the number of internal defects per unit area, and an average value of the determined numbers is set to the number of internal defects. Note that the internal defect is set to one whose maximum dimension is 5 μm or more.

[0.2% Proof Stress]

As will be described later, the fatigue strength is mutually related to the 0.2% proof stress and the tensile strength being tensile properties. For this reason, the increase in the 0.2% proof stress and the tensile strength, enhances the fatigue strength. Besides, the α+β type titanium alloy is used for various members by utilizing its property of high strength, so that the value of 0.2% proof stress is preferably high to some extent. In the chemical component system according to the present embodiment, as long as the 0.2% proof stress is 850 MPa or more, it is possible to satisfy not only the fatigue strength but also the strength when the α+β type titanium alloy wire is used as a member. For this reason, in the α+β type titanium alloy wire according to the present embodiment, the 0.2% proof stress is preferably 850 MPa or more. The 0.2% proof stress of the α+β type titanium alloy wire according to the present embodiment is more preferably 860 MPa or more. On the other hand, an upper limit of the 0.2% proof stress is not particularly defined. However, if the 0.2% proof stress becomes excessively high, the notch sensitivity becomes high, which causes the reduction in the fatigue strength. When the 0.2% proof stress becomes 1200 MPa or more, the notch sensitivity becomes significantly high, so that the 0.2% proof stress of the α+β type titanium alloy wire according to the present embodiment is preferably less than 1200 MPa. The 0.2% proof stress of the α+β type titanium alloy wire according to the present embodiment is more preferably 1100 MPa or less.

Note that the 0.2% proof stress mentioned here is 0.2% proof stress which is obtained when performing a tensile test in which a long axis direction (which is synonymous with a longitudinal direction and a long-length direction) of a titanium alloy wire is a tensile direction.

[Measuring Method of 0.2% Proof Stress]

From a targeted α+β type titanium alloy wire, an ASTM half-size tensile test piece whose longitudinal direction is parallel to the rolling direction (a width of parallel portion of 6.25 mm, a length of parallel portion of 32 mm, and a gauge length of 25 mm) is collected, and the measurement is performed at a strain rate of 0.5%/min until when a strain of 1.5% is obtained, and after that, the measurement is performed at a strain rate of 30%/min until when a fracture occurs. The 0.2% proof stress at this time is measured.

[Fatigue Strength]

The α+β type titanium alloy wire according to the present embodiment is characterized in that it has high fatigue strength. As described above, the shape of structure and the crystal grain diameter exert a large influence on the fatigue properties, and regarding the crystal shape, the fatigue properties are greatly lowered in the acicular structure. Further, even when the equiaxed crystal structure is provided, if the structure is coarse (namely, if the crystal grain diameter is large), the fatigue properties are lowered. In the chemical component system of the α+β type titanium alloy wire according to the present embodiment, the fatigue strength regarding the rotating bending fatigue to be described below is preferably 450 MPa or more, and more preferably 470 MPa or more.

[Measuring Method of Fatigue Strength]

The fatigue properties of the α+β type titanium alloy wire according to the present embodiment are set to employ fatigue properties when the rotating bending fatigue occurs, and are set to fatigue properties when performing measurement by the following method.

Specifically, a manufactured wire is used to produce a round rod test piece which is polished so that a surface roughness of a parallel portion becomes that of an abrasive paper No. 600 smoothness or more. The Ono-type rotating bending test is performed by using this round rod test piece, and a maximum stress at which the fatigue fracture does not occur even if a stress load is repeatedly applied $1\times10^7$ times with a stress ratio R of −1, is determined, which is set to the fatigue strength.

<Manufacturing Method of α+β Type Titanium Alloy Wire>

Subsequently, a manufacturing method of the α+β type titanium alloy wire according to the present embodiment will be described in detail.

The manufacturing method of the α+β type titanium alloy wire according to the present embodiment includes: (a) a first step being a step of performing working of one time or two times or more on a titanium alloy material having the chemical components described above at a working temperature in a range of 0 to 500° C., in which a reduction of area per one time of working is set to 10 to 50%, and a total reduction of area is set to 50% or more; and (b) a second step of performing, with respect to the titanium alloy material after being subjected to the first step, final heat treatment in which a heat treatment temperature T is set to fall within a range of 700° C. to 950° C., and a heat treatment time t is set to a heat treatment time satisfying the following equation (2). Note that in the following equation (2), T indicates the heat treatment temperature (° C.) in the second step, and t indicates the heat treatment time (hr) in the second step.

$$21000<(T+273.15)\times(\log_{10}(t)+20)<24000 \quad (2)$$

Hereinafter, the respective steps in the manufacturing method of the α+β type titanium alloy wire according to the present embodiment will be described in detail.

<<First Step>>

In the first step, the working of one time or two times or more is performed at the working temperature in the range of 0 to 500° C. Consequently, the average crystal grain diameter of the α crystal grain in the structure of the α+β type titanium alloy wire is reduced, and besides, the maximum crystal grain diameter is reduced, to thereby form the equiaxed crystal structure. Note that when the working is performed a plurality of times, intermediate annealing may be performed between the working and the working. The first step as above performs working which is classified as cold working or warm working. Further, the working temperature is set to a temperature at a surface of the α+β type titanium alloy wire.

Note that the α+β type titanium alloy before being subjected to the first step as described above (before being subjected to the cold working or the warm working) has a fine spherical structure with an average grain diameter of about 3.0 μm and an average aspect ratio of 1.5 μm or less, even if it is cut at any cross section.

[Working Temperature]

In the manufacturing method of the α+β type titanium alloy wire according to the present embodiment, by performing the working in a room temperature to medium temperature region in which the working temperature falls within a range of 500° C. or less, it becomes easy to form the aforementioned texture. Further, by performing the working such as rolling or wire drawing in the room temperature to middle temperature region (namely, by performing the cold working or the warm working), it is possible to prevent formation of a coarse proeutectoid α phase, and besides, because of accumulation of dislocation and recrystallization during the following heat treatment (intermediate annealing and final annealing), it is possible to obtain fine and uniform equiaxed grains. Based on the above, in the first step in the manufacturing method of the α+β type titanium alloy wire according to the present embodiment, the working temperature is set to 0° C. or more. The working temperature is preferably 20° C. or more, and more preferably 200° C. or more. On the other hand, if the working temperature becomes excessively high, the dislocation may become difficult to be accumulated, so that the working temperature is set to 500° C. or less at which the diffusion is difficult to occur and the dislocation can be accumulated.

[Working and Reduction of Area]

In the present embodiment, the working is set to be performed at the temperature of 0° C. and more and 500° C. or less, as described above. As types of the working, there can be cited, for example, caliber rolling, roller die wire drawing, hole die wire drawing, and so on. As the working amount becomes higher, the dislocation texture is more easily developed, and the structure is more easily refined because of recrystallization. However, the workability deteriorates in the temperature region of 0° C. or more and 500° C. or less, so that when the working is excessively performed, the internal defect such as void is formed, which causes the reduction in the fatigue properties. If the reduction of area (working ratio) per one time is 10% or more, it is effective for the development of the texture and the recrystallization. For this reason, in the first step according to the present embodiment, the reduction of area per one time of working is set to 10% or more. In order to obtain an additional effect, the reduction of area per one time of working in the first step is preferably 15% or more, and more preferably 20% or more. On the other hand, if the working is performed at the reduction of area exceeding 50% per one time, the internal defect such as void is formed. For this reason, the reduction of area per one time of working in the first step is set to 50% or less.

Furthermore, in order to more securely obtain a uniform and fine equiaxed crystal structure, it is effective to increase the total reduction of area by repeatedly performing the working and the annealing. Specifically, it is effective to repeat a cycle such that the working is performed by setting the reduction of area per one time to 10 to 50%, the intermediate annealing is then performed, the working is performed again at the reduction of area of 10 to 50%, and the intermediate annealing is performed. Further, when the reduction of area per one time is low, by increasing the number of repetition, it is possible to obtain a uniform and fine structure. On the other hand, when the reduction of area per one time is high, it is possible to obtain a uniform and fine structure even if the number of repetition is small.

Further, the present inventors conducted various tests, and as a result of this, when performing working once or a plurality of times, if the total reduction of area is 50% or more, it is possible to obtain a uniform and fine structure. For this reason, in the first step according to the present embodiment, the total reduction of area is set to 50% or more. In the first step according to the present embodiment, the total reduction of area is preferably 60% or more, and more preferably 70% or more. On the other hand, the more the working is performed, the more the recrystallization is likely to occur, so that an upper limit of the total reduction of area is not particularly defined. However, when the number of times of the working and the intermediate annealing is increased, the cost is increased, so that the total reduction of area is preferably set to less than 90%. Further, when the working is performed a plurality of times, the working may be performed so that the reduction of area of each time becomes the same or different every time.

Note that the reduction of area is determined by $100\times(S_1-S_2)/S_1$, based on a cross-sectional area $S_1$ before the working and a cross-sectional area $S_2$ after the working. The total reduction of area when performing the working a plurality of times, is determined by $100\times(S_3-S_4)/S_3$, based on a cross-sectional area $S_3$ before the first working and a cross-sectional area $S_4$ after the final working.

<<Intermediate Annealing and Final Heat Treatment being Second Step>>

Figure 5A:
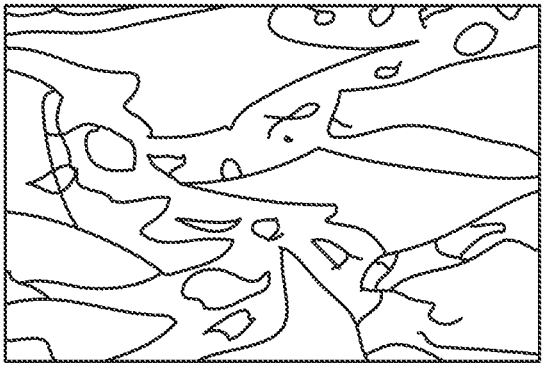
FIG. 5A is an explanatory diagram schematically illustrating one example of a structure in which recrystallization occurs insufficiently, the structure capable of being generated in an α crystal grain of an a+β type titanium alloy wire.
Figure 5B:
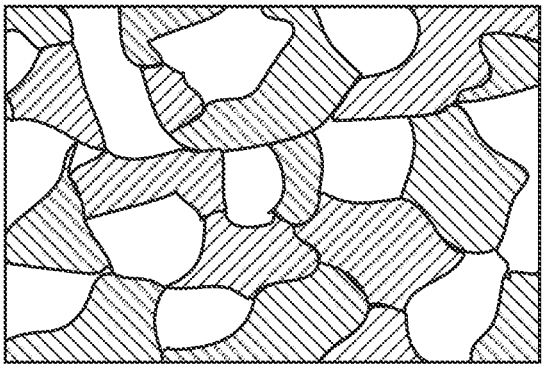
FIG. 5B is an explanatory diagram schematically illustrating one example of a bimodal structure capable of being generated in an α crystal grain of an a+β type titanium alloy wire.

In the present embodiment, the above-described intermediate annealing, and the final heat treatment are set to be performed within a temperature range of 700° C. or more and 950° C. or less. When a heat treatment temperature T is less than 700° C., there is a case where a strain is not recovered sufficiently or recrystallization during the final annealing becomes insufficient, resulting in that an extended grain or an acicular structure remains, as schematically illustrated in FIG. 5A. On the other hand, when the heat treatment temperature T exceeds 950° C., the structure may become coarse due to the excessively high temperature, or the β phase during the heat treatment becomes unstable to cause formation of the acicular structure in the β phase during cooling, resulting in that a bimodal structure being a structure in which the acicular structure and the equiaxed structure exist in a mixed manner, as schematically illustrated in FIG. 5B, is formed. Further, even if the temperature is set to fall within the above-described range, it is not possible to sufficiently remove a strain or cause recrystallization unless a retention time in accordance with the temperature is secured.

As a result of earnest studies conducted by the present inventors, it was clarified that, if a relation between a heat treatment temperature T (° C.) and a heat treatment time (hr) including heating and retention, falls within a range of the following equation (2), it is possible to obtain a uniform and fine equiaxed crystal structure as schematically illustrated in FIG. 1C, without bringing out problems. Accordingly, in the present embodiment, the intermediate annealing and the final heat treatment are set to be performed to satisfy the following equation (2). Here, the heat treatment temperature T (° C.) is set to a temperature at a surface of the α+β type titanium alloy wire.

$$21000<(T+273.15)\times(\log_{10}(t)+20)<24000 \quad (2)$$

By performing the intermediate annealing and the final heat treatment while controlling the heat treatment temperature T and the heat treatment time t to satisfy the relation of the above equation (2), it is possible to facilitate the removal of strain and the recrystallization. A value of $(T+273.15)\times(\log_{10}(t)+20)$ is preferably 24000 or less.

[Heating Rate]

Note that as the heating rate up to the heat treatment temperature T in the intermediate annealing and the final heat treatment becomes faster, the retention time at the above heat treatment temperature T is further increased, and more stabilized removal of strain and more stabilized recrystallization become possible. Although a concrete heating rate is not particularly defined, the heating rate of 1.0° C./s or more is preferable since it is possible to secure a sufficient retention time. The heating rate is more preferably 2.0° C./s or more.

The above is the detailed explanation regarding the manufacturing method of the α+β type titanium alloy wire according to the present embodiment.

Second Embodiment

Hereinafter, an α+β type titanium alloy wire according to a second embodiment of the present disclosure, and a manufacturing method thereof, will be described in detail. The α+β type titanium alloy wire according to the present embodiment is a titanium alloy wire containing Fe and Si, out of the titanium alloy wires whose chemical components are defined by using the Mo equivalent A as described above. The α+β type titanium alloy wire as above is excellent in cold wire drawability, it is inexpensive since it does not contain V, unlike the α+β type titanium alloy wire according to the first embodiment, and it is easily subjected to shaving and cutting.

An α+β type titanium alloy wire according to the present embodiment contains, in mass %, Al: 4.50 to 6.40%, Fe: 0.50 to 2.10%, Si: 0 to 0.50%, C: less than 0.080%, N: 0.050% or less, H: 0.016% or less, O: 0.25% or less, and the balance being Ti and impurities, in which an average aspect ratio of an α crystal grain is 1.0 to 3.0, a maximum crystal grain diameter of the α crystal grain is 30.0 μm or less, an average crystal grain diameter of the α crystal grain is 1.0 to 15.0 μm, and an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5.0% or less.

First, the chemical components of the α+β type titanium alloy wire according to the present embodiment will be described again hereinbelow. In the following explanation, "mass %" will be simply abbreviated to "%".

[Content of Al]

Al is an element with high solid solution strengthening performance, and when its content is increased, tensile strength at room temperature becomes high. In order to more securely obtain desired tensile strength and to more securely control a crystal orientation of a texture to be obtained to fall within a desired range, the content of Al is preferably set to 4.50% or more. The content of Al is more preferably 4.80% or more, and still more preferably 5.00% or more. On the other hand, if Al of more than 6.40% is contained, there is a possibility that a deformation resistance is increased to lower the workability, solidification segregation or the like occurs to excessively solid solution strengthen the a phase, which generates a locally hard region and causes a reduction in fatigue strength, and further, even a reduction in impact toughness is caused. For this reason, the content of Al is preferably set to 6.40% or less. The content of Al is more preferably 5.90% or less, and still more preferably 5.50% or less.

[Content of Fe]

Fe is an inexpensive additive element among the β stabilizing elements, and besides, it is an element with high solid solution strengthening performance. Further, when a content of Fe is increased, tensile strength at room temperature becomes high. In order to obtain required strength and to maintain a β phase with good workability at room temperature, the content of Fe is preferably set to 0.50% or more in the present embodiment. In the present embodiment, the content of Fe is more preferably 0.70% or more, and still more preferably 0.80% or more. On the other hand, Fe is an additive element which is very likely to be subjected to solidification segregation, so that if Fe is excessively contained, there is a possibility that a variation in performance becomes large, and the reduction in fatigue strength occurs depending on places. For this reason, in the present embodiment, the content of Fe is preferably 2.10% or less. In the present embodiment, the content of Fe is more preferably 1.80% or less, and still more preferably 1.50% or less.

[Content of Si]

Si is a β stabilizing element, but, it is solid-dissolved also in the α phase to exhibit a high solid solution strengthening performance. As described above, it is preferable that Fe of greater than 2.10% is not contained from a viewpoint of segregation, so that the strength may be increased through the solid solution strengthening of Si, according to need. For this reason, Si is an arbitrary additive element, and a lower limit of its content is set to 0%. Further, Si exhibits a segregation tendency opposite to that of O to be described below, and besides, Si is difficult to be subjected to solidification segregation when compared to O, so that when a proper amount of Si is combined with O to be contained, it can be expected to realize both high fatigue strength and high tensile strength. Such an effect can be securely exhibited by making the content of Si to be 0.05% or more, so that when Si is contained, the content of Si is preferably set to 0.05% or more, and more preferably set to 0.10% or more. However, as mentioned before, if Si is excessively contained, it forms an intermetallic compound called a silicide, which reduces the fatigue strength. For this reason, in the present embodiment, the content of Si is preferably set to 0.50% or less. In the present embodiment, the content of Si is more preferably 0.45% or less, and still more preferably 0.40% or less.

[Contents of C, N, H, O]

When a content of each of C, N, H, and O is large, there is a case where the ductility and the workability are lowered, so that the content of C is preferably controlled to less than 0.010%, the content of N is preferably controlled to 0.050% or less, the content of H is preferably controlled to 0.016% or less, and the content of O is preferably controlled to 0.25% or less. Note that C, N, H, and O are impurities which are inevitably mixed, so that the lower the content of each of the elements, the more preferable. Further, C, N, H, and O are impurities which are inevitably mixed, and thus they are inevitably contained, so that substantial contents of C, N, H, and O are normally 0.0005%, 0.0001%, 0.0005%, and 0.01%, respectively.

The α+β type titanium alloy wire according to the present embodiment is composed of, other than the above-described elements, Ti and impurities (balance). However, an element other than the above-described respective elements can be contained within a range which does not impair the effect of the present disclosure.

[Contents of Ni, Cr, Mn]

In the α+β type titanium alloy wire according to the present embodiment, one kind or two kinds or more of Ni of less than 0.15%, Cr of less than 0.25%, and Mn of less than 0.25% may be contained in place of a part of Ti being the balance, according to need. Here, the reason why the contents of Ni, Cr, and Mn are set to less than 0.15%, less than 0.25%, and less than 0.25%, respectively, is because, if these elements of greater than the aforementioned upper limits are contained, intermetallic compounds ($Ti_2Ni$, $TiCr_2$, TiMn) being equilibrium phases are generated to deteriorate the fatigue strength and the ductility at room temperature. The content of Ni is more preferably 0.13% or less, and still more preferably 0.11% or less. The content of each of Cr and Mn is more preferably 0.20% or less, and still more preferably 0.15% or less.

[Area Ratio of β Phase]

Also in the metal structure of the α+β type titanium alloy wire according to the present embodiment, the α phase is a main body, and a small amount of β phase exists in the a phase. In the present embodiment, the area ratio of the α phase is 85% or more, and is approximately about 85 to 99%. In the present embodiment, the area ratio of the β phase is approximately about 1 to 15%.

[Average Aspect Ratio of α Crystal Grain]

As mentioned before, in order to improve the fatigue properties, the existence of the equiaxed crystal structure is important. For this reason, in the α+β type titanium alloy wire according to the present embodiment, the average aspect ratio of the α crystal grain is preferably set to 1.0 or more and 3.0 or less. The average aspect ratio of the α crystal grain is more preferably 2.5 or less, and still more preferably 2.3 or less.

[Average Crystal Grain Diameter of 60 Crystal Grain]

Further, in the α+β type titanium alloy wire according to the present embodiment, in order to more securely obtain the effect of reducing the crack initiation, the average crystal grain diameter of the α crystal grain in the α+β type titanium alloy wire is preferably set to 15.0 μm or less as described above. In the present embodiment, the average crystal grain diameter of the α crystal grain is more preferably 12 μm or less, and still more preferably 10 μmm or less.

[Maximum Crystal Grain Diameter of α Crystal Grain]

Further, in order to suppress the reduction in the fatigue strength, in the α+β type titanium alloy wire according to the present embodiment, the maximum crystal grain diameter of the α crystal grain is preferably set to 30.0 μm or less, as described above. The maximum crystal grain diameter of the α crystal grain is more preferably 25.0 μm or less, and still more preferably 20.0 μm or less.

Note that as the measuring methods of the area ratio of the β phase, the average aspect ratio of the α crystal grain, and the α crystal grain, the measuring methods described before may be used, so that detailed explanation thereof will be omitted hereinbelow.

[Texture]

Also in the a+β type titanium alloy wire according to the present embodiment, an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is preferably set to 5.0% or less. The area ratio of the α crystal grain whose angle made with the long axis direction L is within the range of 15° to 40° (the range between the boundary surface B and the boundary surface A), is more preferably 4.0% or less, and still more preferably 3.0% or less. There is no problem if the area ratio of the α crystal grain regarding which the angle made by the c-axis of the hexagonal close packing crystal (hcp) and the long axis direction of the α+β type titanium alloy wire is 15° or more and 40° or less, is low, so that a lower limit of the area ratio is preferably 0%. Note that as the measuring method of the texture, the measuring method described before may be used, so that detailed explanation thereof will be omitted hereinbelow.

[Internal Defect]

As described above, the high-strength α+β type titanium alloy typified by Ti-6Al-4V has poor workability in the range of room temperature to the warm temperature, and an internal defect is likely to occur during deformation working. The internal defect in this case indicates a void or a crack. On the other hand, the fatigue properties to be described later may deteriorate when there are a lot of internal defects.

In the α+β type titanium alloy wire according to the present embodiment, a generation amount of the internal defects (namely, the number of internal defects per unit area) is normally 0 pieces/$mm^2$. However, as a result of earnest studies, as long as the generation amount of the internal defects falls within a range of 13 pieces/$mm^2$ or less, an influence is not exerted on the fatigue properties exhibited in the α+β type titanium alloy wire according to the present embodiment. Note that as the measuring method of the internal defect, the measuring method described above in the first embodiment may be used, so that detailed explanation thereof will be omitted hereinbelow.

[0.2% Proof Stress]

As mentioned before, the fatigue strength is mutually related to the 0.2% proof stress and the tensile strength being the tensile properties. For this reason, the increase in the 0.2% proof stress and the tensile strength, enhances the fatigue strength. Besides, the α+β type titanium alloy is used for various members by utilizing its property of high strength, so that the value of 0.2% proof stress is preferably high to some extent. In the chemical component system according to the present embodiment, as long as the 0.2% proof stress is 700 MPa or more, it is possible to satisfy not only the fatigue strength but also the strength when the α+β type titanium alloy wire is used as a member. For this reason, in the α+β type titanium alloy wire according to the present embodiment, the 0.2% proof stress is preferably 700 MPa or more. The 0.2% proof stress of the α+β type titanium alloy wire according to the present embodiment is more preferably 720 MPa or more. On the other hand, an upper limit of the 0.2% proof stress is not particularly defined. However, if the 0.2% proof stress becomes excessively high, the notch sensitivity becomes high, which causes the reduction in the fatigue strength. When the 0.2% proof stress becomes 1200 MPa or more, the notch sensitivity becomes significantly high, so that the 0.2% proof stress of the α+β type titanium alloy wire according to the present embodiment is preferably less than 1150 MPa. The 0.2% proof stress of the α+β type titanium alloy wire according to the present embodiment is more preferably 1050 MPa or less.

Note that the 0.2% proof stress mentioned here is 0.2% proof stress which is obtained when performing a tensile test in which a long axis direction (which is synonymous with a longitudinal direction and a long-length direction) of a titanium alloy wire is a tensile direction. Note that as the measuring method of the 0.2% proof stress, the measuring method described above in the first embodiment may be used, so that detailed explanation thereof will be omitted hereinbelow.

[Fatigue Strength]

The α+β type titanium alloy wire according to the present embodiment is characterized in that it has high fatigue strength. As described above, the shape of structure and the crystal grain diameter exert a large influence on the fatigue properties, and regarding the crystal shape, the fatigue properties are greatly lowered in the acicular structure. Further, even when the equiaxed crystal structure is provided, if the structure is coarse (namely, if the crystal grain diameter is large), the fatigue properties are lowered. In the chemical component system of the α+β type titanium alloy wire according to the present embodiment, the fatigue strength regarding the rotating bending fatigue to be described below is preferably 400 MPa or more, and more preferably 420 MPa or more. Note that as the measuring method of the fatigue strength, the measuring method described above in the first embodiment may be used, so that detailed explanation thereof will be omitted hereinbelow.

<Manufacturing Method of α+β Type Titanium Alloy Wire>

Note that a manufacturing method of the α+β type titanium alloy wire described above can be carried out similarly to the manufacturing method of the α+β type titanium alloy wire according to the first embodiment, except that a titanium alloy material used for the manufacture is set to have chemical components according to the second embodiment described above. Accordingly, detailed explanation will be omitted hereinbelow.

The above is the detailed explanation regarding the α+β type titanium alloy wire according to each of the embodiments of the present disclosure and the manufacturing method thereof.

EXAMPLES

Hereinafter, the present disclosure will be described more concretely while citing examples. The present disclosure is not limited by the following examples, as a matter of course, the present disclosure can be carried out by being appropriately modified within a range capable of complying with the gist of the present disclosure, and each of those modifications is included in the technical scope of the present disclosure.

Test Example 1

In a test example 1 to be described below, attention is focused mainly on the α+β type titanium alloy wire according to the first embodiment of the present disclosure and the manufacturing method thereof, and they will be described more concretely.

A titanium sponge, scrap, and the predetermined additive elements were used as a melting raw material, and by using a vacuum arc melting furnace, titanium ingots having respective chemical compositions shown in Table 1 below were cast.

By using each of the cast titanium ingots, hot forging was performed. From the obtained hot forged product, a round rod with 100 mmϕ was collected, and hot rolling was performed at 1050° C., to thereby obtain a hot-rolled rod of about ϕ20 mm. After that, the obtained hot-rolled rod was subjected to descaling. When a structure of the obtained hot-rolled rod was checked, there existed a fine spherical structure with an average grain diameter of about 3.0 μm and an average aspect ratio of 1.5 μm or less, in every case where it was cut at any cross section.

After that, wire drawing was performed at a working temperature and a reduction of area shown in Table 2 below as a first step, and subsequently, intermediate annealing was performed in an Ar atmosphere under conditions of a soaking temperature of 850° C. and a soaking retention time of 1.00 hour. Such treatment condition of the intermediate annealing satisfies the relation expressed by the above-described equation (2), even if a heating rate up to the soaking temperature is taken into consideration. After that, the wire drawing and the intermediate annealing were repeatedly performed, to thereby perform wire drawing until the total reduction of area shown in Table 2 was obtained. Here, the "reduction of area" in Table 2 below indicates a reduction of area between the n-th intermediate annealing and the (n+1)-th intermediate annealing, and the intermediate annealing was carried out every time the wire drawing at a predetermined reduction of area was performed, as described above. After that, final heat treatment under conditions shown in Table 2 was performed as a second step, to thereby manufacture an α+β type titanium alloy wire. From the obtained α+β type titanium alloy wire, various test pieces were produced.

The manufacturing conditions of the α+β type titanium alloy wire are shown in Table 2. Further, Table 3 shows reductions of area of patterns A to F in Table 2. The reductions of area shown in Table 3 are reductions of area of respective times when the reduction of area in the working in the first step was changed for each number of times of the working. Between the working and the working, the intermediate annealing was performed under the above-described conditions.

TABLE 1

| RAW MATERIAL | ALLOY COMPONENT (mass %) Al | V | Fe | O | N | C | H | Ti | Mo EQUIVALENT A (mass %) |
|---|---|---|---|---|---|---|---|---|---|
| A | 6.37 | 4.22 | 0.18 | 0.18 | 0.003 | 0.003 | 0.002 | Bal. | −3.0 |
| B | 6.39 | 4.24 | 0.17 | 0.12 | 0.002 | 0.005 | 0.001 | Bal. | −3.1 |
| C | 6.75 | 3.69 | 0.10 | 0.16 | 0.003 | 0.001 | 0.001 | Bal. | −4.0 |
| D | 5.50 | 4.18 | 0.18 | 0.15 | 0.002 | 0.001 | 0.002 | Bal. | −2.2 |
| E | 5.71 | 4.50 | 0.17 | 0.25 | 0.003 | 0.004 | 0.002 | Bal. | −2.2 |
| F | 6.41 | 3.51 | 0.16 | 0.20 | 0.001 | 0.003 | 0.001 | Bal. | −3.6 |

TABLE 2

| No. | RAW MATERIAL | MANUFACTURING METHOD WORKING TEMPERATURE (° C.) | REDUCTION OF AREA (%) | INTERMEDIATE ANNEALING |
|---|---|---|---|---|
| EXAMPLE 1 | A | 20 | 10 | PRESENCE |
| EXAMPLE 2 | B | 20 | 10 | PRESENCE |
| EXAMPLE 3 | B | 20 | 15 | PRESENCE |
| EXAMPLE 4 | B | 20 | 30 | PRESENCE |

TABLE 2-continued

| | | | | |
|---|---|---|---|---|
| EXAMPLE 5 | B | 20 | PATTERN A | PRESENCE |
| EXAMPLE 6 | B | 20 | PATTERN B | PRESENCE |
| EXAMPLE 7 | B | 20 | 10 | PRESENCE |
| EXAMPLE 8 | B | 20 | 10 | PRESENCE |
| EXAMPLE 9 | B | 20 | 10 | PRESENCE |
| EXAMPLE 10 | B | 20 | 10 | PRESENCE |
| EXAMPLE 11 | A | 200 | 20 | PRESENCE |
| EXAMPLE 12 | B | 200 | 10 | PRESENCE |
| EXAMPLE 13 | B | 200 | 20 | PRESENCE |
| EXAMPLE 14 | B | 200 | 35 | PRESENCE |
| EXAMPLE 15 | B | 200 | PATTERN C | PRESENCE |
| EXAMPLE 16 | B | 200 | PATTERN D | PRESENCE |
| EXAMPLE 17 | B | 200 | 20 | PRESENCE |
| EXAMPLE 18 | B | 200 | 20 | PRESENCE |
| EXAMPLE 19 | B | 200 | 20 | PRESENCE |
| EXAMPLE 20 | B | 200 | 20 | PRESENCE |
| EXAMPLE 21 | B | 200 | 20 | PRESENCE |
| EXAMPLE 22 | B | 500 | 50 | PRESENCE |
| EXAMPLE 23 | B | 500 | PATTERN E | PRESENCE |
| EXAMPLE 24 | B | 500 | PATTERN F | PRESENCE |
| EXAMPLE 25 | B | 500 | 50 | — |
| EXAMPLE 26 | C | 200 | 20 | PRESENCE |
| EXAMPLE 27 | D | 200 | 20 | PRESENCE |
| EXAMPLE 28 | E | 200 | 20 | PRESENCE |
| EXAMPLE 29 | F | 200 | 20 | PRESENCE |
| COMPARATIVE EXAMPLE 1 | B | 200 | 20 | PRESENCE |
| COMPARATIVE EXAMPLE 2 | B | 200 | 20 | PRESENCE |
| COMPARATIVE EXAMPLE 3 | B | 200 | 20 | PRESENCE |
| COMPARATIVE EXAMPLE 4 | B | 550 | 30 | PRESENCE |
| COMPARATIVE EXAMPLE 5 | B | 200 | 20 | PRESENCE |
| COMPARATIVE EXAMPLE 6 | B | 900 | 50 | PRESENCE |
| COMPARATIVE EXAMPLE 7 | B | 200 | 60 | PRESENCE |
| COMPARATIVE EXAMPLE 8 | B | 200 | 20 | PRESENCE |
| COMPARATIVE EXAMPLE 9 | B | 200 | 20 | PRESENCE |
| COMPARATIVE EXAMPLE 10 | B | 200 | 20 | PRESENCE |

| | MANUFACTURING METHOD | | | |
|---|---|---|---|---|
| | | FINAL HEAT TREATMENT | | |
| No. | TOTAL REDUCTION OF AREA (%) | HEAT TREATMENT TEMPERATURE T (° C.) | HEAT TREATMENT TIME t (hr) | VALUE OF MIDDLE SIDE OF EQUATION (2) |
| EXAMPLE 1 | 72 | 850 | 2.00 | 22801 |
| EXAMPLE 2 | 72 | 850 | 2.00 | 22801 |
| EXAMPLE 3 | 73 | 850 | 2.00 | 22801 |
| EXAMPLE 4 | 74 | 850 | 2.00 | 22801 |
| EXAMPLE 5 | 72 | 850 | 2.00 | 22801 |
| EXAMPLE 6 | 72 | 850 | 2.00 | 22801 |
| EXAMPLE 7 | 72 | 700 | 39.00 | 21011 |
| EXAMPLE 8 | 72 | 850 | 0.05 | 21002 |
| EXAMPLE 9 | 72 | 850 | 23.00 | 23992 |
| EXAMPLE 10 | 72 | 950 | 0.40 | 23976 |
| EXAMPLE 11 | 74 | 850 | 2.00 | 22801 |
| EXAMPLE 12 | 72 | 850 | 2.00 | 22801 |
| EXAMPLE 13 | 74 | 850 | 2.00 | 22801 |
| EXAMPLE 14 | 68 | 850 | 2.00 | 22801 |
| EXAMPLE 15 | 75 | 850 | 2.00 | 22801 |
| EXAMPLE 16 | 75 | 850 | 2.00 | 22801 |
| EXAMPLE 17 | 59 | 850 | 2.00 | 22801 |
| EXAMPLE 18 | 74 | 700 | 39.00 | 21011 |
| EXAMPLE 19 | 74 | 850 | 0.05 | 21002 |
| EXAMPLE 20 | 74 | 850 | 23.00 | 23992 |
| EXAMPLE 21 | 74 | 950 | 0.40 | 23976 |
| EXAMPLE 22 | 75 | 850 | 2.00 | 22801 |
| EXAMPLE 23 | 69 | 850 | 2.00 | 22801 |
| EXAMPLE 24 | 69 | 850 | 2.00 | 22801 |
| EXAMPLE 25 | 50 | 850 | 2.00 | 22801 |
| EXAMPLE 26 | 74 | 850 | 2.00 | 22801 |
| EXAMPLE 27 | 74 | 850 | 2.00 | 22801 |
| EXAMPLE 28 | 74 | 850 | 2.00 | 22801 |
| EXAMPLE 29 | 74 | 850 | 2.00 | 22801 |
| COMPARATIVE EXAMPLE 1 | 72 | 850 | 0.04 | 20893 |
| COMPARATIVE EXAMPLE 2 | 72 | 850 | 50.00 | 24371 |
| COMPARATIVE EXAMPLE 3 | 72 | 950 | 2.00 | 24831 |
| COMPARATIVE EXAMPLE 4 | 72 | 850 | 2.00 | 22801 |
| COMPARATIVE EXAMPLE 5 | 72 | 700 | 35.00 | 20966 |

TABLE 2-continued

| | | | | |
|---|---|---|---|---|
| COMPARATIVE EXAMPLE 6 | 75 | 850 | 2.00 | 22801 |
| COMPARATIVE EXAMPLE 7 | 84 | 850 | 2.00 | 22801 |
| COMPARATIVE EXAMPLE 8 | 36 | 850 | 2.00 | 22801 |
| COMPARATIVE EXAMPLE 9 | 72 | 650 | 560.00 | 21000 |
| COMPARATIVE EXAMPLE 10 | 72 | 1000 | 0.08 | 24066 |

TABLE 3

| | NUMBER OF TIMES OF WORKING | | | | | |
|---|---|---|---|---|---|---|
| PATTERN | FIRST TIME | SECOND TIME | THIRD TIME | FOURTH TIME | FIFTH TIME | SIXTH TIME |
| PATTERN A | 10 | 10 | 15 | 15 | 30 | 30 |
| PATTERN B | 30 | 30 | 15 | 15 | 10 | 10 |
| PATTERN C | 10 | 20 | 20 | 35 | 35 | — |
| PATTERN D | 35 | 35 | 20 | 20 | 10 | — |
| PATTERN E | 10 | 30 | 50 | — | — | — |
| PATTERN F | 50 | 30 | 10 | — | — | — |

Regarding the obtained test pieces, the observation of microstructure, and measurement of the respective properties (the 0.2 proof stress and the fatigue strength) were performed.

(Average Aspect Ratio of α Crystal Grain)

An L cross section cut from the a+β type titanium alloy wire (a cross section orthogonal to a long axis direction of the wire), was turned into a mirror surface by electrolytic polishing or colloidal silica polishing, and then measurement was performed by using an EBSD (OIM Analysis software manufactured by TSL Solutions Co., Ltd.). Concretely, in a region with a size of 500 μm×500 μm in the L cross section after being turned into the mirror surface, the measurement was performed with respect to about 2 to 10 fields of view at a step of 0.5 to 1 μm. After that, when a misorientation of 5° or more occurred, it was regarded that a grain boundary was created, a ratio of maximum lengths in a long axis direction of each crystal grain and a direction orthogonal to the long axis (long axis/short axis), namely, an aspect ratio was calculated, and an average value of all crystal grains (average aspect ratio) was calculated.

(Average Crystal Grain Diameter and Maximum Crystal Grain Diameter of α Crystal Grain)

The crystal grain diameter was measured in a manner that the L cross section of the obtained test piece was turned into a mirror surface by electrolytic polishing or colloidal silica polishing, and then measurement was performed by using the EBSD (OIM Analysis software manufactured by TSL Solutions Co., Ltd.). Concretely, in a region with a size of 500 μm×500 μm in the L cross section after being turned into the mirror surface, the measurement was performed with respect to about 2 to 10 fields of view at a step of 0.5 to 1 μm. After that, when a misorientation of 5° or more occurred, it was regarded that a grain boundary was created, and a circle-equivalent grain diameter D for each crystal grain was determined from a crystal grain area A (crystal grain area $A=\pi\times(D/2)^2$). The average crystal grain diameter was set to an average value of all crystal grain diameters within the measurement range. Further, the maximum crystal grain diameter was set to a maximum value within the measurement range. Note that it was possible to easily distinguish the a crystal grain and the other crystal grain such as the β crystal grain in a technical manner on the EBSD.

(Area Ratio of α Crystal Grain Regarding which Angle Made by Long Axis Direction and C-Axis was 15 to 40°)

In a similar manner to the measuring method of the crystal grain diameter described above, the L cross section of the obtained test piece was turned into a mirror surface by electrolytic polishing or colloidal silica polishing, and then measurement was performed by using the EBSD (OIM Analysis software manufactured by TSL Solutions Co., Ltd.). Concretely, in a region with a size of 500 μm×500 μm, the measurement was performed with respect to about 2 to 10 fields of view at a step of 0.5 to 1 μm, and an area ratio of the α crystal grain regarding which the angle made by the c-axis of the hexagonal close packing crystal (hcp) and the long axis direction of the α+β type titanium alloy wire in each field of view was 15° or more and 40° or less, was determined. After that, an average of the area ratios obtained from the respective fields of view was calculated.

Note that in the observation of microstructure, based on the measurement results of the EBSD, areas of individual crystal grains including β crystal grains as well, lengths of a long axis and a short axis, and aspect ratios were calculated by using the analysis software (OIM Analysis manufactured by TSL Solutions Co., Ltd.).

(Internal Defect)

A C cross section cut from the α+β type titanium alloy wire was turned into a mirror surface by using an emery paper and buffing, and then the internal defect was measured by using an optical microscope. Photographing was performed on 10 to 20 fields of view at 50 to 500 magnifications, the number of defects such as voids or cracks that existed in each field of view was measured, the number was divided by an observation area to determine the number of internal defects per unit area, and an average value of the determined numbers was set to the number of internal defects. Note that the internal defect was set to one with a maximum dimension of 5 μm or more.

(0.2% Proof Stress)

From the obtained α+β type titanium alloy wire, an ASTM half-size tensile test piece whose longitudinal direction was parallel to the rolling direction (a width of parallel portion of 6.25 mm, a length of parallel portion of 32 mm, and a gauge length of 25 mm) was collected, and the measurement was performed at a strain rate of 0.5%/min until when a strain of 1.5% was obtained, and after that, the measurement was performed at a strain rate of 30%/min until when a fracture occurred. The 0.2% proof stress at this time was measured. In the present test example, a case where the obtained 0.2% proof stress was 850 MPa or more and less than 1200 MPa was regarded as acceptable.

(Fatigue Strength)

The fatigue properties were set to employ fatigue properties when the rotating bending fatigue occurred, and were set to properties obtained when performing measurement by the following method. From the obtained α+β type titanium alloy wire, a round rod test piece which was polished so that a surface roughness of a parallel portion became that of an abrasive paper No. 600 smoothness or more, was produced. This round rod test piece was subjected to the Ono-type rotating bending test, and a maximum stress at which the fatigue fracture did not occur even if a stress load was repeatedly applied $1\times10^7$ times with a stress ratio R of −1, was set to the fatigue strength. In the present test example, a case where the obtained fatigue strength was 450 MPa or more was regarded as acceptable.

The obtained results are collectively shown in Table 4 below. Examples 1 to 29 are examples of the present disclosure. It can be understood that each of the α+β type titanium alloy wires of the examples 1 to 29 has excellent fatigue strength.

On the other hand, in comparative examples 1 to 3, 5, 9, and 10, the heat treatment time in the final heat treatment did not satisfy the manufacturing condition of the present disclosure, and thus the average aspect ratio, the average crystal grain diameter, or the maximum crystal grain diameter was out of the range of the present disclosure, resulting in that the fatigue strength was below 450 MPa. In comparative examples 4 and 6, since the working temperature was excessively high, it was not possible to control the crystal orientation of the c-axis in the hcp forming the α crystal grain to fall within the predetermined range, resulting in that the fatigue strength was below 450 MPa. In a comparative example 7, the reduction of area per one time was excessively high to be greater than 50%, and thus the fatigue strength was below 450 MPa. Further, it was clarified that the internal defects were also increased. In a comparative example 8, the total reduction of area was less than 50%, and thus the fatigue strength was below 450 MPa.

Note that an underline in Table 2 and Table 4 indicates that the underlined value is out of the range of the present disclosure.

TABLE 4

| | | MICROSTRUCTURE | | | |
|---|---|---|---|---|---|
| | RAW | AREA RATIO OF β PHASE | AVERAGE ASPECT | CRYSTAL GRAIN DIAMETER (μm) | |
| No. | MATERIAL | (%) | RATIO | AVERAGE | MAXIMUM |
| EXAMPLE 1 | A | 5.6 | 2.3 | 3.1 | 9.1 |
| EXAMPLE 2 | B | 4.8 | 2.3 | 3.3 | 7.8 |
| EXAMPLE 3 | B | 5.3 | 2.1 | 2.8 | 7.5 |
| EXAMPLE 4 | B | 5.5 | 1.9 | 2.7 | 6.3 |
| EXAMPLE 5 | B | 6.1 | 1.9 | 2.7 | 6.5 |
| EXAMPLE 6 | B | 5.8 | 2.0 | 3.1 | 6.4 |
| EXAMPLE 7 | B | 3.0 | 2.4 | 3.7 | 9.6 |
| EXAMPLE 8 | B | 4.1 | 2.6 | 3.0 | 7.2 |
| EXAMPLE 9 | B | 20.0 | 1.6 | 3.1 | 11.8 |
| EXAMPLE 10 | B | 9.8 | 1.6 | 3.2 | 7.9 |
| EXAMPLE 11 | A | 4.5 | 2.3 | 3.2 | 9.3 |
| EXAMPLE 12 | B | 4.8 | 2.2 | 3.5 | 7.1 |
| EXAMPLE 13 | B | 5.1 | 2.2 | 3.0 | 7.8 |
| EXAMPLE 14 | B | 4.9 | 1.8 | 1.5 | 6.6 |
| EXAMPLE 15 | B | 5.2 | 1.9 | 1.7 | 6.4 |
| EXAMPLE 16 | B | 5.3 | 1.8 | 1.9 | 6.6 |
| EXAMPLE 11 | B | 4.9 | 2.9 | 6.5 | 18.2 |
| EXAMPLE 18 | B | 3.2 | 2.3 | 3.6 | 9.6 |
| EXAMPLE 19 | B | 3.9 | 2.6 | 3.2 | 7.5 |
| EXAMPLE 20 | B | 18.5 | 1.5 | 3.4 | 11.9 |
| EXAMPLE 21 | B | 11.1 | 1.5 | 3.4 | 8.4 |
| EXAMPLE 22 | B | 5.1 | 1.2 | 1.0 | 4.8 |
| EXAMPLE 23 | B | 4.9 | 1.3 | 7.0 | 7.0 |
| EXAMPLE 24 | B | 5.3 | 1.1 | 6.5 | 8.0 |
| EXAMPLE 25 | B | 4.9 | 1.4 | 8.5 | 20.0 |
| EXAMPLE 26 | C | 4.1 | 2.3 | 3.2 | 9.3 |
| EXAMPLE 27 | D | 5.1 | 4.8 | 3.1 | 8.5 |
| EXAMPLE 28 | E | 6.3 | 1.4 | 3.3 | 8.7 |
| EXAMPLE 29 | F | 3.1 | 1.6 | 3.6 | 10.2 |
| COMPARATIVE EXAMPLE 1 | B | 3.9 | 3.5 | 6.2 | 18.6 |
| COMPARATIVE EXAMPLE 2 | B | 22.5 | 2.4 | 10.5 | 19.7 |
| COMPARATIVE EXAMPLE 3 | B | 21.3 | 2.9 | 9.8 | 22.3 |
| COMPARATIVE EXAMPLE 4 | B | 5.2 | 1.8 | 8.9 | 15.3 |
| COMPARATIVE EXAMPLE 5 | B | 3.2 | 3.2 | 3.6 | 9.6 |
| COMPARATIVE EXAMPLE 6 | B | 4.9 | 15.0 | 12.3 | 25.6 |
| COMPARATIVE EXAMPLE 7 | B | 4.7 | 1.3 | 3.3 | 7.6 |
| COMPARATIVE EXAMPLE 8 | B | 5.1 | 14.0 | 8.6 | 29.0 |
| COMPARATIVE EXAMPLE 9 | B | 4.8 | 13.2 | 9.1 | 21.0 |
| COMPARATIVE EXAMPLE 10 | B | 3.0 | 100.0 | 25.0 | 35.0 |

TABLE 4-continued

| No. | MICROSTRUCTURE: AREA RATIO OF α CRYSTAL GRAIN REGARDING WHICH ANGLE MADE BY c-AXIS AND LONGITUDINAL DIRECTION OF WIRE IS WITHIN 15 TO 40° (%) | INTERNAL DEFECT (/mm²) | PROPERTY: 0.2% PROOF STRESS (MPa) | FATIGUE STRENGTH (MPa) |
|---|---|---|---|---|
| EXAMPLE 1 | 1.2 | 0 | 912 | 500 |
| EXAMPLE 2 | 1.3 | 1 | 870 | 470 |
| EXAMPLE 3 | 0.9 | 5 | 862 | 455 |
| EXAMPLE 4 | 0.8 | 13 | 875 | 450 |
| EXAMPLE 5 | 0.8 | 2 | 868 | 465 |
| EXAMPLE 6 | 0.7 | 8 | 866 | 450 |
| EXAMPLE 7 | 1.5 | 0 | 865 | 475 |
| EXAMPLE 8 | 1.2 | 1 | 860 | 465 |
| EXAMPLE 9 | 0.9 | 1 | 857 | 470 |
| EXAMPLE 10 | 0.8 | 0 | 865 | 470 |
| EXAMPLE 11 | 0.7 | 0 | 908 | 505 |
| EXAMPLE 12 | 1.3 | 0 | 863 | 455 |
| EXAMPLE 13 | 0.7 | 1 | 865 | 465 |
| EXAMPLE 14 | 0.9 | 10 | 872 | 450 |
| EXAMPLE 15 | 0.9 | 1 | 877 | 465 |
| EXAMPLE 16 | 1.0 | 8 | 856 | 450 |
| EXAMPLE 11 | 4.5 | 1 | 853 | 460 |
| EXAMPLE 18 | 0.8 | 0 | 861 | 465 |
| EXAMPLE 19 | 0.9 | 1 | 855 | 470 |
| EXAMPLE 20 | 0.7 | 2 | 863 | 470 |
| EXAMPLE 21 | 1.2 | 0 | 862 | 465 |
| EXAMPLE 22 | 2.6 | 2 | 882 | 480 |
| EXAMPLE 23 | 2.2 | 1 | 882 | 475 |
| EXAMPLE 24 | 2.3 | 1 | 885 | 465 |
| EXAMPLE 25 | 4.1 | 3 | 876 | 455 |
| EXAMPLE 26 | 0.7 | 0 | 898 | 505 |
| EXAMPLE 27 | 0.9 | 0 | 850 | 480 |
| EXAMPLE 28 | 1.1 | 8 | 940 | 460 |
| EXAMPLE 29 | 0.6 | 3 | 935 | 455 |
| COMPARATIVE EXAMPLE 1 | 8.4 | 1 | 852 | 440 |
| COMPARATIVE EXAMPLE 2 | 8.7 | 0 | 854 | 445 |
| COMPARATIVE EXAMPLE 3 | 9.8 | 1 | 848 | 430 |
| COMPARATIVE EXAMPLE 4 | 16.3 | 0 | 862 | 435 |
| COMPARATIVE EXAMPLE 5 | 0.8 | 0 | 861 | 445 |
| COMPARATIVE EXAMPLE 6 | 15.4 | 0 | 871 | 440 |
| COMPARATIVE EXAMPLE 7 | 0.8 | 15 | 898 | 380 |
| COMPARATIVE EXAMPLE 8 | 16.0 | 1 | 845 | 420 |
| COMPARATIVE EXAMPLE 9 | 1.1 | 0 | 846 | 430 |
| COMPARATIVE EXAMPLE 10 | 27.0 | 2 | 835 | 400 |

Test Example 2

In a test example 2 to be described below, attention is focused mainly on the α+β type titanium alloy wire according to the second embodiment of the present disclosure and the manufacturing method thereof, and they will be described more concretely.

A titanium sponge, scrap, and the predetermined additive elements were used as a melting raw material, and by using a vacuum arc melting furnace, titanium ingots having respective chemical compositions shown in Table 5 below were cast.

By using each of the cast titanium ingots, hot forging was performed. From the obtained hot forged product, a round rod with 100 mmϕ was collected, and hot rolling was performed at 1050° C., to thereby obtain a hot-rolled rod of about ϕ20 mm. After that, the obtained hot-rolled rod was subjected to descaling. When a structure of the obtained hot-rolled rod was checked, there existed a fine spherical structure with an average grain diameter of about 3.0 μm and an average aspect ratio of 1.5 μm or less, in every case where it was cut at any cross section.

After that, wire drawing was performed at a working temperature and a reduction of area shown in Table 6 below as a first step, and subsequently, intermediate annealing was performed in an Ar atmosphere under conditions of a soaking temperature of 850° C. and a soaking retention time of 1.00 hour. Such treatment condition of the intermediate annealing satisfies the relation expressed by the above-described equation (2), even if a heating rate up to the soaking temperature is taken into consideration. After that, the wire drawing and the intermediate annealing were repeatedly performed, to thereby perform wire drawing until the total reduction of area shown in Table 5 was obtained. Here, the "reduction of area" in Table 6 below indicates a reduction of area between the n-th intermediate annealing and the (n+1)-th intermediate annealing, and the intermediate annealing was carried out every time the wire drawing at a predetermined reduction of area was performed, as described above. After that, final heat treatment under conditions shown in Table 5 was performed as a second step, to thereby manufacture an α+β type titanium alloy wire. From the obtained α+β type titanium alloy wire, various test pieces were produced.

The manufacturing conditions of the α+β type titanium alloy wire are shown in Table 6. Further, Table 7 shows reductions of area of patterns A to F in Table 6. The reductions of area shown in Table 7 are reductions of area of respective times when the reduction of area in the working in the first step was changed for each number of times of the working. Between the working and the working, the intermediate annealing was performed under the above-described conditions.

TABLE 5

| | ALLOY COMPONENT (mass %) | | | | | | | | | | | | | Mo EQUIVALENT A |
|---|---|---|---|---|---|---|---|---|---|---|---|---|---|---|
| No. | Al | Fe | Si | Ni | Cr | Mn | Mo | Nb | C | N | 0 | H | Ti | (mass %) |
| a | 4.80 | 1.00 | — | — | — | — | — | — | 0.007 | 0.009 | 0.12 | 0.002 | Bal. | −1.9 |
| b | 5.30 | 1.10 | — | — | — | — | — | — | 0.008 | 0.007 | 0.15 | 0.001 | Bal. | −2.1 |
| c | 5.10 | 1.00 | — | — | — | — | — | — | 0.007 | 0.005 | 0.23 | 0.002 | Bal. | −2.2 |
| d | 4.70 | 2.00 | — | — | — | — | — | — | 0.005 | 0.005 | 0.12 | 0.001 | Bal. | 1.1 |
| e | 5.20 | 1.50 | 0.25 | — | — | — | — | — | 0.007 | 0.008 | 0.15 | 0.001 | Bal. | −0.9 |
| f | 5.10 | 1.30 | 0.35 | — | — | — | — | — | 0.008 | 0.007 | 0.13 | 0.001 | Bal. | −1.3 |
| g | 5.30 | 0.90 | — | 0.14 | — | — | — | — | 0.005 | 0.007 | 0.15 | 0.002 | Bal. | −2.5 |
| h | 4.60 | 0.70 | — | — | 0.24 | — | — | — | 0.006 | 0.007 | 0.15 | 0.003 | Bal. | −2.2 |
| i | 5.10 | 0.80 | — | — | — | 0.24 | — | — | 0.008 | 0.008 | 0.15 | 0.002 | Bal. | −2.4 |
| j | 5.10 | 0.80 | — | 0.11 | 0.21 | — | — | — | 0.007 | 0.008 | 0.17 | 0.002 | Bal. | −2.3 |
| k | 6.10 | 1.10 | — | — | — | — | — | — | 0.007 | 0.008 | 0.18 | 0.003 | Bal. | −2.9 |
| l | 5.00 | 0.50 | — | — | — | — | — | 3.00 | 0.007 | 0.008 | 0.17 | 0.001 | Bal. | −2.7 |
| m | 5.00 | — | — | — | — | — | 4.50 | — | 0.005 | 0.005 | 0.12 | 0.001 | Bal. | −0.5 |
| n | 6.10 | 0.90 | — | — | — | — | — | — | 0.007 | 0.008 | 0.17 | 0.002 | Bal. | −3.5 |
| o | 4.50 | 2.00 | — | — | — | — | 0.50 | — | 0.008 | 0.007 | 0.15 | 0.002 | Bal. | 1.8 |

TABLE 6

| | | MANUFACTURING METHOD | | |
|---|---|---|---|---|
| No. | RAW MATERIAL | WORKING TEMPERATURE (° C.) | REDUCTION OF AREA (%) | INTERMEDIATE ANNEALING |
| EXAMPLE 30 | a | 20 | 10 | PRESENCE |
| EXAMPLE 31 | b | 20 | 15 | PRESENCE |
| EXAMPLE 32 | c | 20 | 20 | PRESENCE |
| EXAMPLE 33 | d | 20 | 25 | PRESENCE |
| EXAMPLE 34 | e | 20 | PATTERN A | PRESENCE |
| EXAMPLE 35 | f | 20 | PATTERN B | PRESENCE |
| EXAMPLE 36 | g | 20 | 15 | PRESENCE |
| EXAMPLE 37 | h | 20 | 15 | PRESENCE |
| EXAMPLE 38 | i | 20 | 15 | PRESENCE |
| EXAMPLE 39 | j | 20 | 15 | PRESENCE |
| EXAMPLE 40 | k | 20 | 15 | PRESENCE |
| EXAMPLE 41 | a | 200 | 20 | PRESENCE |
| EXAMPLE 42 | e | 200 | 10 | PRESENCE |
| EXAMPLE 43 | e | 200 | 20 | PRESENCE |
| EXAMPLE 44 | a | 200 | 35 | PRESENCE |
| EXAMPLE 45 | e | 200 | PATTERN C | PRESENCE |
| EXAMPLE 46 | a | 200 | PATTERN D | PRESENCE |
| EXAMPLE 47 | a | 200 | 20 | PRESENCE |
| EXAMPLE 48 | a | 200 | 25 | PRESENCE |
| EXAMPLE 49 | k | 200 | 25 | PRESENCE |
| EXAMPLE 50 | a | 500 | 50 | PRESENCE |
| EXAMPLE 51 | e | 500 | 50 | — |
| EXAMPLE 52 | a | 500 | PATTERN E | PRESENCE |
| EXAMPLE 53 | a | 500 | PATTERN F | PRESENCE |
| EXAMPLE 54 | l | 200 | 20 | PRESENCE |
| EXAMPLE 55 | m | 200 | 20 | PRESENCE |
| EXAMPLE 56 | n | 200 | 20 | PRESENCE |
| EXAMPLE 57 | o | 200 | PATTERN A | PRESENCE |
| COMPARATIVE EXAMPLE 11 | a | 200 | 20 | PRESENCE |
| COMPARATIVE EXAMPLE 12 | a | 200 | 20 | PRESENCE |
| COMPARATIVE EXAMPLE 13 | a | 500 | 70 | — |
| COMPARATIVE EXAMPLE 14 | a | 900 | 50 | — |
| COMPARATIVE EXAMPLE 15 | a | 200 | 20 | PRESENCE |
| COMPARATIVE EXAMPLE 16 | a | 200 | 20 | PRESENCE |
| COMPARATIVE EXAMPLE 17 | a | 200 | 20 | PRESENCE |

TABLE 6-continued

| No. | MANUFACTURING METHOD | | | |
|---|---|---|---|---|
| | | FINAL HEAT TREATMENT | | |
| | TOTAL REDUCTION OF AREA (%) | HEAT TREATMENT TEMPERATURE T (° C.) | HEAT TREATMENT TIME t (hr) | VALUE OF MIDDLE SIDE OF EQUATION (2) |
| EXAMPLE 30 | 72 | 850 | 1.00 | 22463 |
| EXAMPLE 31 | 72 | 850 | 1.00 | 22463 |
| EXAMPLE 32 | 73 | 850 | 1.00 | 22463 |
| EXAMPLE 33 | 74 | 850 | 1.00 | 22463 |
| EXAMPLE 34 | 72 | 850 | 1.00 | 22463 |
| EXAMPLE 35 | 72 | 700 | 40.00 | 21022 |
| EXAMPLE 36 | 73 | 850 | 1.00 | 22463 |
| EXAMPLE 37 | 73 | 850 | 1.00 | 22463 |
| EXAMPLE 38 | 73 | 950 | 0.20 | 23608 |
| EXAMPLE 39 | 62 | 950 | 0.20 | 23608 |
| EXAMPLE 40 | 62 | 950 | 0.20 | 23608 |
| EXAMPLE 41 | 74 | 850 | 1.00 | 22463 |
| EXAMPLE 42 | 72 | 850 | 1.00 | 22463 |
| EXAMPLE 43 | 74 | 850 | 1.00 | 22463 |
| EXAMPLE 44 | 73 | 850 | 1.00 | 22463 |
| EXAMPLE 45 | 75 | 850 | 1.00 | 22463 |
| EXAMPLE 46 | 75 | 700 | 40.00 | 21022 |
| EXAMPLE 47 | 59 | 850 | 1.00 | 22463 |
| EXAMPLE 48 | 76 | 950 | 0.20 | 23608 |
| EXAMPLE 49 | 76 | 950 | 0.20 | 23608 |
| EXAMPLE 50 | 75 | 850 | 1.00 | 22463 |
| EXAMPLE 51 | 50 | 850 | 1.00 | 22463 |
| EXAMPLE 52 | 69 | 700 | 40.00 | 21022 |
| EXAMPLE 53 | 69 | 850 | 1.00 | 22463 |
| EXAMPLE 54 | 74 | 850 | 1.00 | 21022 |
| EXAMPLE 55 | 74 | 850 | 1.00 | 21022 |
| EXAMPLE 56 | 74 | 850 | 1.00 | 21022 |
| EXAMPLE 57 | 74 | 850 | 1.00 | 21022 |
| COMPARATIVE EXAMPLE 11 | 72 | 850 | 0.04 | 20893 |
| COMPARATIVE EXAMPLE 12 | 72 | 850 | 50.00 | 24371 |
| COMPARATIVE EXAMPLE 13 | 70 | 850 | 2.00 | 22801 |
| COMPARATIVE EXAMPLE 14 | 50 | 850 | 1.00 | 22463 |
| COMPARATIVE EXAMPLE 15 | 36 | 700 | 1.00 | 19463 |
| COMPARATIVE EXAMPLE 16 | 74 | 650 | 1.00 | 22463 |
| COMPARATIVE EXAMPLE 17 | 74 | 1000 | 1.00 | 22463 |

TABLE 7

| PATTERN | NUMBER OF TIMES OF WORKING | | | | | |
|---|---|---|---|---|---|---|
| | FIRST TIME | SECOND TIME | THIRD TIME | FOURTH TIME | FIFTH TIME | SIXTH TIME |
| PATTERN A | 10 | 10 | 15 | 15 | 30 | 30 |
| PATTERN B | 30 | 30 | 15 | 15 | 10 | 10 |
| PATTERN C | 10 | 20 | 20 | 35 | 35 | — |
| PATTERN D | 35 | 35 | 20 | 20 | 10 | — |
| PATTERN E | 10 | 30 | 50 | — | — | — |
| PATTERN F | 50 | 30 | 10 | — | — | — |

Regarding the obtained test pieces, the observation of microstructure, and measurement of the respective properties (the 0.2 proof stress and the fatigue strength) were performed.

(Average Aspect Ratio of α Crystal Grain)

An L cross section cut from the a+β type titanium alloy wire (a cross section orthogonal to a long axis direction of the wire), was turned into a mirror surface by electrolytic polishing or colloidal silica polishing, and then measurement was performed by using an EBSD (OIM Analysis software manufactured by TSL Solutions Co., Ltd.). Concretely, in a region with a size of 500 um×500 μm in the L cross section after being turned into the mirror surface, the measurement was performed with respect to about 2 to 10 fields of view at a step of 0.5 to 1 μm. After that, when a misorientation of 5° or more occurred, it was regarded that a grain boundary was created, a ratio of maximum lengths in a long axis direction of each crystal grain and a direction orthogonal to the long axis (long axis/short axis), namely, an aspect ratio was calculated, and an average value of all crystal grains (average aspect ratio) was calculated.

(Average Crystal Grain Diameter and Maximum Crystal Grain Diameter of α Crystal Grain)

The crystal grain diameter was measured in a manner that the L cross section of the obtained test piece was turned into a mirror surface by electrolytic polishing or colloidal silica polishing, and then measurement was performed by using the EBSD (OIM Analysis software manufactured by TSL Solutions Co., Ltd.). Concretely, in a region with a size of 500 μm×500 μm in the L cross section after being turned into the mirror surface, the measurement was performed with respect to about 2 to 10 fields of view at a step of 0.5 to 1 μm. After that, when a misorientation of 5° or more occurred, it was regarded that a grain boundary was created, and a circle-equivalent grain diameter D for each crystal grain was determined from a crystal grain area A (crystal grain area $A=\pi\times(D/2)^2$). The average crystal grain diameter was set to an average value of all crystal grain diameters within the measurement range. Further, the maximum crystal grain diameter was set to a maximum value within the measurement range. Note that it was possible to easily distinguish the α crystal grain and the other crystal grain such as the β crystal grain in a technical manner on the EBSD.

(Area Ratio of α Crystal Grain Regarding which Angle Made by Long Axis Direction and C-Axis was 15 to 40°)

In a similar manner to the measuring method of the crystal grain diameter described above, the L cross section of the obtained test piece was turned into a mirror surface by electrolytic polishing or colloidal silica polishing, and then measurement was performed by using the EBSD (OIM Analysis software manufactured by TSL Solutions Co., Ltd.). Concretely, in a region with a size of 500 μm×500 μm, the measurement was performed with respect to about 2 to 10 fields of view at a step of 0.5 to 1 μm, and an area ratio of the α crystal grain regarding which the angle made by the c-axis of the hexagonal close packing crystal (hcp) and the long axis direction of the α+β type titanium alloy wire in each field of view was 15° or more and 40° or less, was determined. After that, an average of the area ratios obtained from the respective fields of view was calculated.

Note that in the observation of microstructure, based on the measurement results of the EBSD, areas of individual crystal grains including β crystal grains as well, lengths of a long axis and a short axis, and aspect ratios were calculated by using the analysis software (OIM Analysis manufactured by TSL Solutions Co., Ltd.).

(Internal Defect)

A C cross section cut from the α+β type titanium alloy wire was turned into a mirror surface by using an emery paper and buffing, and then the internal defect was measured by using an optical microscope. Photographing was performed on 10 to 20 fields of view at 50 to 500 magnifications, the number of defects such as voids or cracks that existed in each field of view was measured, the number was divided by an observation area to determine the number of internal defects per unit area, and an average value of the determined numbers was set to the number of internal defects. Note that the internal defect was set to one with a maximum dimension of 5 μm or more.

(0.2% Proof Stress)

From the obtained α+β type titanium alloy wire, an ASTM half-size tensile test piece whose longitudinal direction was parallel to the rolling direction (a width of parallel portion of 6.25 mm, a length of parallel portion of 32 mm, and a gauge length of 25 mm) was collected, and the measurement was performed at a strain rate of 0.5%/min until when a strain of 1.5% was obtained, and after that, the measurement was performed at a strain rate of 30%/min until when a fracture occurred. The 0.2% proof stress at this time was measured. In the present test example, a case where the obtained 0.2% proof stress was 700 MPa or more and less than 1200 MPa was regarded as acceptable.

(Fatigue Strength)

The fatigue properties were set to employ fatigue properties when the rotating bending fatigue occurred, and were set to properties obtained when performing measurement by the following method. From the obtained α+β type titanium alloy wire, a round rod test piece which was polished so that a surface roughness of a parallel portion became that of an abrasive paper No. 600 smoothness or more, was produced. This round rod test piece was subjected to the Ono-type rotating bending test, and a maximum stress at which the fatigue fracture did not occur even if a stress load was repeatedly applied $1\times10^7$ times with a stress ratio R of −1, was set to the fatigue strength. In the present test example, a case where the obtained fatigue strength was 400 MPa or more was regarded as acceptable.

The obtained results are collectively shown in Table 8 below. Examples 30 to 57 are examples of the present disclosure. It can be understood that each of the α+β type titanium alloy wires of the examples 30 to 57 has excellent fatigue strength.

On the other hand, in comparative examples 11, 12, and 15, the heat treatment time in the final heat treatment did not satisfy the manufacturing condition of the present disclosure, and thus the average aspect ratio or the crystal grain diameter was out of the range of the present disclosure, resulting in that the fatigue strength was below 400 MPa. In a comparative example 13, since the reduction of area per one time was excessively high to be greater than 50%, a fracture occurred during the wire drawing, and thus it was not possible to perform detailed evaluation. In a comparative example 14, the working temperature was excessively high, so that it was not possible to control the crystal orientation of the c-axis in the hcp forming the α crystal grain to fall within the predetermined range, resulting in that the fatigue strength was below 400 MPa. In the comparative example 15, the total reduction of area was less than 50%, and thus the fatigue strength was below 400 MPa. In a comparative example 16, the heat treatment temperature in the final heat treatment was less than 700° C., so that the average aspect ratio was out of the range of the present disclosure, resulting in that the fatigue strength was below 400 MPa. In a comparative example 17, the heat treatment temperature in the final heat treatment was greater than 950° C., so that the average aspect ratio and the crystal grain diameter were out of the range of the present disclosure, resulting in that the fatigue strength was below 400 MPa.

Note that an underline in Table 6 and Table 8 indicates that the underlined value is out of the range of the present disclosure.

TABLE 8

| No | RAW MATERIAL | MICROSTRUCTURE: AREA RATIO OF β PHASE (%) | MICROSTRUCTURE: AVERAGE ASPECT RATIO | MICROSTRUCTURE: CRYSTAL GRAIN DIAMETER (μm) AVERAGE | MICROSTRUCTURE: CRYSTAL GRAIN DIAMETER (μm) MAXIMUM |
|---|---|---|---|---|---|
| EXAMPLE 30 | a | 4.1 | 2.3 | 7.1 | 18.1 |
| EXAMPLE 31 | b | 4.2 | 2.3 | 7.3 | 14.8 |
| EXAMPLE 32 | c | 3.9 | 2.1 | 6.8 | 14.5 |
| EXAMPLE 33 | d | 2.1 | 1.9 | 6.7 | 13.3 |
| EXAMPLE 34 | e | 4.3 | 2.8 | 11.5 | 24.3 |
| EXAMPLE 35 | f | 3.2 | 2.4 | 7.7 | 16.6 |
| EXAMPLE 36 | g | 4.1 | 2.6 | 7.0 | 14.2 |
| EXAMPLE 37 | h | 1.8 | 2.6 | 7.0 | 14.2 |
| EXAMPLE 38 | i | 7.4 | 1.6 | 7.1 | 14.9 |
| EXAMPLE 39 | j | 1.9 | 1.6 | 14.5 | 28.5 |
| EXAMPLE 40 | k | 3.9 | 1.6 | 14.5 | 28.5 |
| EXAMPLE 41 | a | 3.9 | 2.3 | 7.2 | 16.3 |
| EXAMPLE 42 | e | 4.5 | 2.2 | 7.5 | 14.1 |
| EXAMPLE 43 | e | 4.3 | 2.2 | 7.0 | 14.8 |
| EXAMPLE 44 | a | 4.1 | 1.8 | 5.5 | 13.6 |
| EXAMPLE 45 | e | 4.2 | 2.9 | 7.5 | 19.5 |
| EXAMPLE 46 | a | 1.5 | 2.3 | 7.6 | 16.6 |
| EXAMPLE 47 | a | 4.1 | 2.6 | 10.5 | 25.2 |
| EXAMPLE 48 | a | 4.1 | 1.5 | 5.3 | 11.0 |
| EXAMPLE 49 | k | 3.9 | 1.5 | 5.3 | 11.0 |
| EXAMPLE 50 | a | 4.2 | 1.2 | 7.0 | 11.8 |
| EXAMPLE 51 | e | 5.6 | 1.4 | 14.5 | 28.5 |
| EXAMPLE 52 | a | 1.0 | 2.8 | 10.5 | 18.5 |
| EXAMPLE 53 | a | 4.1 | 2.7 | 11.3 | 21.3 |
| EXAMPLE 54 | l | 4.3 | 2.2 | 7.1 | 14.6 |
| EXAMPLE 55 | m | 4.1 | 2.4 | 8.5 | 15.2 |
| EXAMPLE 56 | n | 1.0 | 2.4 | 6.8 | 12.4 |
| EXAMPLE 57 | o | 15.0 | 2.2 | 6.2 | 15.9 |
| COMPARATIVE EXAMPLE 11 | a | 0.8 | 4.5 | 10.2 | 23.6 |
| COMPARATIVE EXAMPLE 12 | a | 13.0 | 2.4 | 16.5 | 33.0 |
| COMPARATIVE EXAMPLE 13 | a | 4.4 | FRACTURE OCCURRED DURING WIRE DRAWING | | |
| COMPARATIVE EXAMPLE 14 | a | 4.2 | 15.0 | 16.3 | 30.6 |
| COMPARATIVE EXAMPLE 15 | a | 2.8 | 14.0 | 14.5 | 40.0 |
| COMPARATIVE EXAMPLE 16 | a | 2.4 | 3.8 | 6.8 | 14.8 |
| COMPARATIVE EXAMPLE 17 | a | 1.9 | 105.0 | 25.0 | 32.0 |

| No | MICROSTRUCTURE: AREA RATIO OF α CRYSTAL GRAIN REGARDING WHICH ANGLE MADE BY c-AXIS AND LONGITUDINAL DIRECTION OF WIRE IS WITHIN 15 TO 40° (%) | INTERNAL DEFECT (/mm²) | PROPERTY: 0.2% PROOF STRESS (MPa) | PROPERTY: FATIGUE STRENGTH (MPa) |
|---|---|---|---|---|
| EXAMPLE 30 | 1.2 | 0 | 710 | 430 |
| EXAMPLE 31 | 1.3 | 1 | 760 | 430 |
| EXAMPLE 32 | 0.9 | 5 | 830 | 440 |
| EXAMPLE 33 | 0.8 | 12 | 750 | 410 |
| EXAMPLE 34 | 5.0 | 0 | 830 | 420 |
| EXAMPLE 35 | 1.5 | 0 | 800 | 450 |
| EXAMPLE 36 | 1.2 | 1 | 750 | 420 |
| EXAMPLE 37 | 1.2 | 1 | 720 | 420 |
| EXAMPLE 38 | 0.8 | 0 | 740 | 420 |
| EXAMPLE 39 | 1.2 | 2 | 740 | 410 |
| EXAMPLE 40 | 1.2 | 2 | 865 | 440 |
| EXAMPLE 41 | 0.7 | 0 | 710 | 430 |
| EXAMPLE 42 | 1.3 | 0 | 830 | 440 |
| EXAMPLE 43 | 0.7 | 1 | 830 | 430 |
| EXAMPLE 44 | 0.9 | 13 | 710 | 400 |
| EXAMPLE 45 | 4.5 | 1 | 830 | 450 |
| EXAMPLE 46 | 0.8 | 0 | 710 | 420 |
| EXAMPLE 47 | 4.5 | 1 | 710 | 410 |
| EXAMPLE 48 | 1.2 | 0 | 710 | 420 |
| EXAMPLE 49 | 1.2 | 0 | 865 | 440 |
| EXAMPLE 50 | 2.6 | 10 | 710 | 400 |

TABLE 8-continued

| | | | | |
|---|---|---|---|---|
| EXAMPLE 51 | 4.1 | 3 | 820 | 410 |
| EXAMPLE 52 | 5.0 | 0 | 710 | 420 |
| EXAMPLE 53 | 4.8 | 0 | 710 | 420 |
| EXAMPLE 54 | 0.7 | 2 | 870 | 430 |
| EXAMPLE 55 | 0.5 | 1 | 830 | 420 |
| EXAMPLE 56 | 0.9 | 5 | 875 | 400 |
| EXAMPLE 57 | 1.1 | 0 | 720 | 400 |
| COMPARATIVE EXAMPLE 11 | 8.4 | 1 | 710 | 390 |
| COMPARATIVE EXAMPLE 12 | 8.7 | 0 | 700 | 380 |
| COMPARATIVE EXAMPLE 13 | FRACTURE OCCURRED DURING WIRE DRAWING | | | |
| COMPARATIVE EXAMPLE 14 | 15.4 | 0 | 710 | 360 |
| COMPARATIVE EXAMPLE 15 | 16.0 | 1 | 710 | 380 |
| COMPARATIVE EXAMPLE 16 | 0.7 | 1 | 830 | 390 |
| COMPARATIVE EXAMPLE 17 | 27.0 | 0 | 835 | 370 |

Although the preferred embodiments of the present disclosure have been described above in detail while referring to the attached drawings, the present disclosure is not limited to such examples. It should be understood that various changes or modifications are readily apparent to those having ordinary knowledge in the technical field to which the present disclosure pertains within the scope of the technical spirit as set forth in claims, and those should also be covered by the technical scope of the present disclosure as a matter of course.

EXPLANATION OF CODES

A, B boundary surface
L long axis direction

What is claimed is:

1. An α+β type titanium alloy wire, containing: in mass %,

Al: 4.50 to 6.75%;
Si: 0 to 0.50%;
C: 0.080% or less;
N: 0.050% or less;
H: 0.016% or less;
O: 0.25% or less;
Mo: 0 to 5.5%;
V: 0 to 4.50%;
Nb: 0 to 3.0%;
Fe: 0 to 2.10%;
Cr: 0 to less than 0.25%;
Ni: 0 to less than 0.15%;
Mn: 0 to less than 0.25%; and
the balance being Ti and impurities,
the contents of Al, Mo, V, Nb, Fe, Cr, Ni, and Mn satisfying the following equation (1), wherein:
a diameter of the wire of 15 mm or less:
an average aspect ratio of an α crystal grain is 1.0 to 3.0;
a maximum crystal grain diameter of the α crystal grain is 30.0 μm or less;
an average crystal grain diameter of the α crystal grain is 1.0 μm to 15.0 μm; and
an area ratio of the α crystal grain, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5.0% or less, $$-4.0 \leq [Mo]+0.67\,[V]+0.28\,[Nb]+2.9\,[Fe]+1.6\,[Cr]+1.1\,[Ni]+1.6\,[Mn]-[Al] \leq 2.0 \quad (1)$$

in the above equation (1), notation of [symbol of element] represents a content (mass %) of a corresponding symbol of element, and a symbol of element which is not contained, is substituted by 0.

2. The α-β type titanium alloy wire according to claim 1 containing: in mass %, Al: 5.50 to 6.75%;
V: 3.50 to 4.50%; and
Fe: 0.10 to 0.40%.

3. The α-β type titanium alloy wire according to claim 1 containing: in mass %, Al: 4.50 to 6.40%; and
Fe: 0.50 to 2.10%.

4. The α+β type titanium alloy wire according to claim 1, wherein the number of internal defects per unit area is 0 pieces/$mm^2$ to 13 pieces/$mm^2$.

5. A manufacturing method of an α+β type titanium alloy wire being a method of manufacturing a α+β type titanium alloy wire, containing: in mass %, Al: 4.50 to 6.75%;
Si: 0 to 0.50%;
C: 0.080% or less;
N: 0.050% or less;
H: 0.016% or less;
O: 0.25% or less;
Mo: 0 to 5.5%;
V: 0 to 4.50%;
Nb: 0 to 3.0%;
Fe: 0 to 2.10%;
Cr: 0 to less than 0.25%;
Ni: 0 to less than 0.15%;
Mn: 0 to less than 0.25%; and
the balance being Ti and impurities,
the contents of Al, Mo, V, Nb, Fe, Cr, Ni, and Mn satisfying the following equation (1), wherein:
a diameter of the wire is 15 mm ore less:
an average aspect ratio of an α crystal grain is 1.0 to 3.0;
a maximum crystal grain diameter of the α crystal grain is 30.0 μm or less;
an average crystal grain diameter of the α crystal grain is 1.0 μm to 15.0 μm; and
an area ratio of the α crystal gram, out of the α crystal grains in a cross section orthogonal to a long axis direction of the wire, regarding which an inclination angle in a c-axis direction of a hexagonal close packing crystal that forms the α crystal grain relative to the long axis direction is within a range of 15° to 40°, is 5% or less, $$-4.0 \leq [Mo]0.67\ [V]+0.28\ [Nb]+2.9\ [Fe]+1.6\ [Cr]+1.1\ [Ni]+1.6\ [Mn]-[Al] \leq 2.0 \quad (1)$$

in the above equation (1), notation of [symbol of element] represents a content (mass %) of a corresponding symbol of element, and a symbol of element which is not contained, is substituted by 0, the method comprising:

first performing working of one time or two times or more on a titanium alloy material comprising the chemical components in the α+β type titanium alloy wire at a working temperature in a range of 0° C. to 500° C., in which a reduction of area per one time of working is set to 10 to 50%, and a total reduction of area is set to 50% or more; and second performing, with respect to the titanium alloy material after being subjected to the first performing, final heat treatment in which a heat treatment temperature T is set to fall within a range of 700° C. to 950° C., and a heat treatment time t is set to a heat treatment time satisfying the following equation (2), $$21000 < (T+273.15) \times (\log_{10}(t)+20) < 24000 \quad (2)$$

Here, in the above equation (2), T indicates the heat treatment temperature (° C.) in the second performing, and t indicates the heat treatment time (hr) in the second performing.

6. The manufacturing method of the α+β type titanium alloy wire according to claim 5, wherein when the working is performed a plurality of times in the first performing, intermediate annealing is performed between the working and the working.

* * * * *